US012709445B2

(12) United States Patent
Hagee et al.

(10) Patent No.: US 12,709,445 B2
(45) **Date of Patent: *Aug. 18, 2026**

(54) DISPENSING PACKAGE FOR A FLOOR TREATMENT COMPOSITION

(71) Applicant: The Procter & Gamble Company, Cincinnati, OH (US)

(72) Inventors: Richard Christopher Hagee, Cincinnati, OH (US); William Michael Cannon, West Harrison, IN (US); John Charles Van Rens, Cincinnati, OH (US); Kerry Lloyd Weaver, Florence, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 243 days.

This patent is subject to a terminal disclaimer.

(21) Appl. No.: 18/514,546

(22) Filed: Nov. 20, 2023

(65) Prior Publication Data

US 2024/0132260 A1 Apr. 25, 2024

Related U.S. Application Data

(63) Continuation of application No. 17/972,245, filed on Oct. 24, 2022, now Pat. No. 11,858,697.

(51) Int. Cl.

| | |
|---|---|
| ***B65D 47/12*** | (2006.01) |
| ***A47L 13/22*** | (2006.01) |
| ***A47L 13/42*** | (2006.01) |

(52) U.S. Cl.

CPC ..... *B65D 47/123* (2013.01); *A47L 13/22* (2013.01); *A47L 13/42* (2013.01)

(58) Field of Classification Search

CPC ..... B65D 47/123; B65D 51/002; A47L 13/22; A47L 13/42; A47L 11/125; A47L 11/4083; A47L 11/4088

See application file for complete search history.

(56) References Cited

U.S. PATENT DOCUMENTS

| | | | |
|---|---|---|---|
| 2,543,934 | A | 3/1951 | Fred |
| 2,589,206 | A | 3/1952 | Tegarty |
| 2,834,036 | A | 5/1958 | Shannon |
| 2,935,754 | A | 5/1960 | Abdo et al. |

(Continued)

FOREIGN PATENT DOCUMENTS

| | | | |
|---|---|---|---|
| EP | 3148391 | B1 | 4/2017 |
| EP | 3949822 | A1 | 2/2022 |

(Continued)

OTHER PUBLICATIONS

All Office Actions; U.S. Appl. No. 19/087,782, filed on Mar. 24, 2025.

(Continued)

*Primary Examiner* — Donnell A Long

(74) *Attorney, Agent, or Firm* — Gary J. Foose

(57) ABSTRACT

A dispensing package for a floor treatment composition. The dispensing package includes a coupling shell and a container. The coupling shell is provided with a dispensing opening and at least one front aperture. The container includes a membrane seal engaged with a sealing surface of the container. The coupling shell can provide for a connection between a container and a dispensing system.

20 Claims, 14 Drawing Sheets

(56) References Cited

U.S. PATENT DOCUMENTS

| | | | | |
|---|---|---|---|---|
| 3,198,437 | A | 8/1965 | Faglie | |
| 3,200,994 | A | 8/1965 | Levinson et al. | |
| 3,434,629 | A | 3/1969 | Hooge et al. | |
| 3,985,299 | A | 10/1976 | Brenez | |
| 4,173,858 | A | 11/1979 | Cassia | |
| 4,863,299 | A | 9/1989 | Osberghaus et al. | |
| 5,086,950 | A | 2/1992 | Crossdale et al. | |
| 6,152,327 | A | 11/2000 | Rhine et al. | |
| 6,164,495 | A | 12/2000 | Manesis | |
| 6,269,837 | B1 | 8/2001 | Arent et al. | |
| 6,386,392 | B1 | 5/2002 | Argentieri | |
| 6,939,072 | B2 | 9/2005 | Thiebaut | |
| 6,971,589 | B2 | 12/2005 | Incardona et al. | |
| 7,837,132 | B2 | 11/2010 | Mazooji et al. | |
| 9,868,584 | B2 | 1/2018 | Harada | |
| 11,858,697 | B1 | 1/2024 | Hagee | |
| 11,858,698 | B1 | 1/2024 | Weaver | |
| 11,905,079 | B1 | 2/2024 | Van Rens | |
| 2002/0166573 | A1 | 11/2002 | Policicchio et al. | |
| 2003/0077105 | A1 | 4/2003 | Hall et al. | |
| 2003/0209263 | A1 | 11/2003 | Bell et al. | |
| 2004/0076463 | A1 | 4/2004 | Hall et al. | |
| 2004/0134016 | A1 | 7/2004 | Kisela et al. | |
| 2004/0141798 | A1 | 7/2004 | Garabedian et al. | |
| 2004/0206772 | A1 | 10/2004 | Leifheit et al. | |
| 2004/0223803 | A1* | 11/2004 | Fahy | A47L 1/15 401/138 |
| 2005/0058500 | A1 | 3/2005 | Hall et al. | |
| 2005/0254882 | A1 | 11/2005 | Hofte et al. | |
| 2006/0123587 | A1* | 6/2006 | Parr | A47L 11/4075 15/320 |
| 2012/0279010 | A1 | 11/2012 | Kenter et al. | |
| 2014/0305079 | A1 | 10/2014 | Ware | |
| 2017/0360272 | A1 | 12/2017 | Perry et al. | |
| 2019/0274514 | A1 | 9/2019 | Leao et al. | |
| 2020/0060495 | A1* | 2/2020 | Davila | A47L 9/0477 |
| 2020/0197966 | A1 | 6/2020 | Marshall et al. | |
| 2024/0130596 | A1 | 4/2024 | Cannon | |
| 2024/0130599 | A1 | 4/2024 | Kerry | |
| 2024/0132261 | A1 | 4/2024 | Kerry | |
| 2024/0150089 | A1 | 5/2024 | Van Rens | |

FOREIGN PATENT DOCUMENTS

| | | | |
|---|---|---|---|
| GB | 1000042 | A | 8/1965 |
| GB | 2513840 | A | 11/2014 |
| WO | 2004062457 | A2 | 7/2004 |

OTHER PUBLICATIONS

U.S. Appl. No. 19/087,782, filed Mar. 24, 2025, to John Charles Van Rens et al.

All Office Actions; U.S. Appl. No. 19/182,927, filed on Apr. 18, 2025; See Patent Center.

U.S. Appl. No. 19/182,927, filed Apr. 18, 2025, to Kerr yLloyd Weaver et al. See Patent Center.

PCT Search Report and Written Opinion for PCT/US2023/077040; dated Feb. 9, 2024, 12 pages.

All Office Actions; U.S. Appl. No. 18/410,099, filed on Jan. 11, 2024.

All Office Actions; U.S. Appl. No. 18/514,584, filed on Nov. 20, 2023.

All Office Actions; U.S. Appl. No. 17/972,210, filed on Oct. 24, 2022.

All Office Actions; U.S. Appl. No. 17/972,245, filed on Oct. 24, 2022.

All Office Actions; U.S. Appl. No. 17/972,255, filed on Oct. 24, 2022.

All Office Actions; U.S. Appl. No. 17/972,266, filed on Oct. 24, 2022.

All Office Actions; U.S. Appl. No. 17/972,234, filed on Oct. 24, 2022.

* cited by examiner

DISPENSING PACKAGE FOR A FLOOR TREATMENT COMPOSITION

FIELD OF THE INVENTION

Dispensing packages for a floor treatment composition

BACKGROUND OF THE INVENTION

There are a variety of dispensing systems for floor treatment compositions in which a container containing a floor treatment composition is engaged with a mop. In such systems, floor treatment composition is dispensed from the container directly to the floor or to the floor via a component of the mop. In one arrangement, an inverted container is engaged with the mop in some manner and floor treatment composition is dispensed from the container by a trigger dispenser, an electrical pump, or is gravity fed.

When a person mops a floor, it is common for the mop head to collide with furniture resting on the floor, the base of cabinets, objects projecting from the floor, or other objects that impede movement of the mop head. These collisions generate rapid decelerations of the mop. Even if such collisions do not occur, a typical mopping pattern employed by users is a reciprocal movement in which the mop is accelerated and decelerated along a line or in an approximately elliptical or approximately circular pattern. The accelerations and decelerations, especially those generated by collisions, can generate large forces at the connection between the container and the mop.

The large forces generated by accelerations and decelerations of the mop can cause the connection between the container and the mop to become leaky. Leaks can be dissatisfying to the user because floor treatment composition may be wasted, the user may come into contact with the floor treatment composition, and the user may have to clean up a mess of leaked floor treatment composition.

Some dispensing systems for floor treatment compositions employ a cannula that penetrates a membrane seal on the container. The cannula provides for a liquid transport pathway from within the container to locations downstream of the cannula. In some configurations, after the membrane seal is applied the container to close the container, the membrane seal remains exposed to the environment. The membrane seal may sometimes be unintentionally ruptured when the container is packed into secondary packaging, is placed on a palate for shipping, during shipping, is handled in a retail environment, or is handled by a user of the floor treatment composition. A leaking membrane seal can be dissatisfying to manufacturers, shippers, retailers, and users since floor treatment composition may be wasted, the handler may come into contact with the floor treatment composition, and the handler may have to clean up a mess of leaked floor treatment composition.

Some containers for floor treatment compositions intended for use with a mop device are plastic bottles having a base, a body extending from the base, a shoulder extending from the body, and a neck at the top of the container extending from the shoulder. A closure of some sort is fitted to the neck in some manner. The neck is typically narrower in cross section than the body. Such containers are typically impractical to display or store in an inverted position in which the neck is oriented towards the shelf upon which the container rests since a small footprint supporting a large, elevated mass distributed more broadly than the footprint tends to be unstable with respect to tipping.

With the above limitations in mind, there is a continuing unaddressed need for dispensing systems for floor treatment compositions in which the dispensing container containing the floor treatment composition can be robustly engaged with the dispensing system so as reduce the potential for leakage. There is a further continuing unaddressed need for a dispensing container for floor treatment compositions that provide for protection of the membrane seal after the membrane seal is applied to the container. There is a further continuing unaddressed need for a dispensing container for floor treatment compositions that can be stably displayed or stored in an upright or inverted position.

SUMMARY OF THE INVENTION

A dispensing package for a floor treatment composition, the dispensing package comprising: a coupling shell comprising a top wall, wherein the top wall has a top wall periphery and a shell wall extending from the top wall periphery, wherein the top wall and the shell wall partially define a shell interior, wherein the top wall has a longitudinal axis, a transverse axis orthogonal to the longitudinal axis and intersecting the longitudinal axis at a z-axis, wherein the z-axis is orthogonal to the longitudinal axis and the transverse axis, wherein the coupling shell further comprises: a front aperture in the top wall; a dispensing opening in the top wall and aligned with the z-axis; a neck fitment at least partially surrounding the dispensing opening and projecting from the top wall into the shell interior and aligned with the z-axis; and a container comprising a base, and body wall extending from the base towards the coupling shell and extending around the z-axis, a shoulder extending from the body wall to a neck that extends around the z-axis, a finish that extends around the z-axis and extends from the neck to a sealing surface that extends around the z-axis, and a membrane seal engaged with the sealing surface, wherein the neck fitment is engaged with the neck; wherein the top wall is spaced apart from the shoulder.

DETAILED DESCRIPTION OF THE INVENTION

Figure 1:
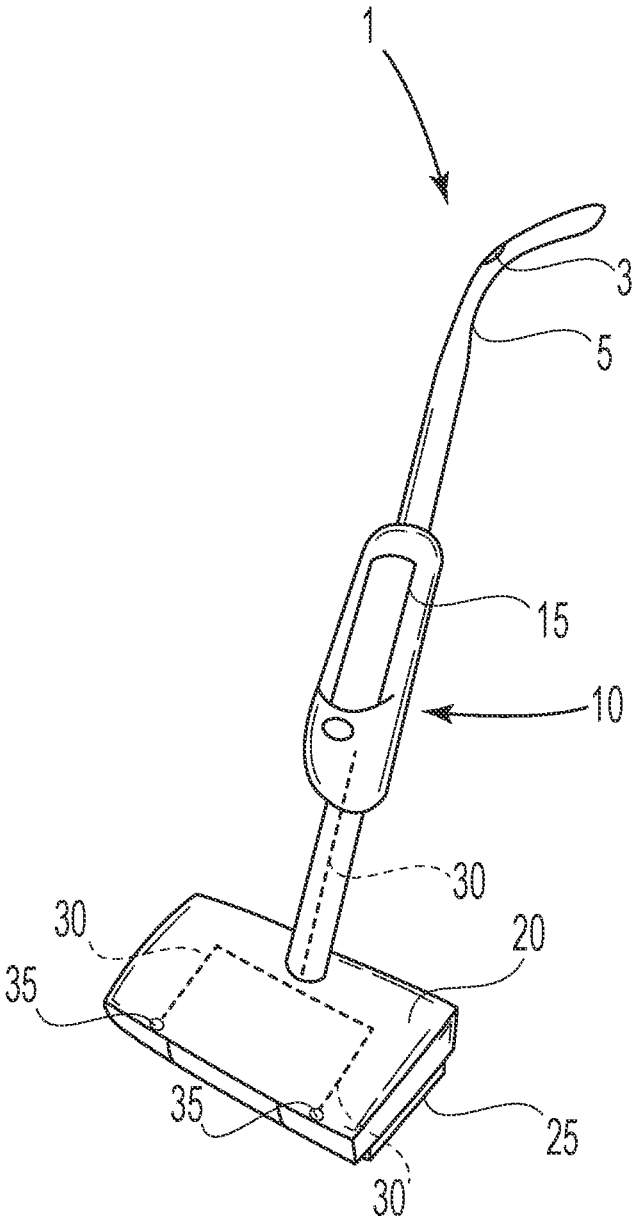
FIG. 1 is a device for cleaning or treating a floor.

A device 1 for dispensing a floor treatment composition is shown in FIG. 1. The device 1 can comprise a handle 5, a dispensing system 10, a dispensing package 15, and a mop head 20. The dispensing system 10 can comprise a dispensing package 15. In operation, the dispensing system 10 can dispense floor treatment composition contained in the dispensing package 15 from the dispensing package 15 to the floor.

In use, the user of the device 1 can acquire a dispensing package 15 that contains the floor treatment composition. The user can install the dispensing package 15 into the device 1 and then use the device 1. The user can use the device 1 to treat a floor by applying floor treatment composition to the floor and manipulating the device 1 to travel across the floor. The floor treatment composition can be, by way of nonlimiting example, a floor cleaning composition, a floor disinfecting composition, a floor scenting composition, a floor polishing composition, a floor friction enhancing composition, and the like.

The floor treatment composition can comprise surfactant and water. Optionally, the floor treatment composition can further comprise perfume. Optionally the floor treatment composition can comprise components selected from acrylic polymer, didecyldimethylammonium chloride, chlorhexidine diacetate, propylene glycol butyl ether, phenoxyisopropanol, fragrance, alkyl dimethyl amine oxide, alkyl polyglucoside, and water. The floor treatment composition can comprise C10-C16 alkyldimethylamine oxide.

The floor treatment composition can comprise from about 0.001 wt % to about 15 wt % surfactant, a cationic antimicrobial active, a nitrogen-containing polymer, and water. The surfactant can be selected from the group of nonionic surfactant, anionic surfactant, zwitterionic surfactant, amphoteric surfactant, and mixtures thereof. The surfactant can be nonionic surfactant. The floor treatment composition can comprise from about 0.001 wt % to about 0.5 wt % surfactant and from about 0.005 wt % to about 1 wt % cationic antimicrobial active. The floor treatment composition can comprise about 95 wt % to about 99.994 wt % water. The floor treatment composition can comprise from about 0.005 wt % to about 1 wt % nitrogen-containing polymer. The floor treatment composition can comprise from about 0.001 wt % to about 0.5 wt % perfume.

The mop head 20 be or have attached thereto a sponge, brush, abrasive material, bundle of strips of textiles, bundle of fibers, and the like. Optionally, a wipe 25 can be attached to the mop head 20. The wipe 25 can be a disposable or reusable wipe.

The mop head 20 can have a generally rectangular shape having a width from about 200 mm to about 500 mm, optionally about 350 mm, and a length from about 50 mm to about 200 mm, optionally about 100 mm. The wipe 25 can be a nonwoven wipe. Optionally the wipe 25 can be a laminate of nonwoven layers. The wipe 25 can optionally comprise an absorbent core between the surface of the wipe 25 intended to contact the floor and a backsheet that is attachable to and detachable from the mop head 20. The wipe 25 can be the same as or substantially similar to the wipe 25 provided as part of SWIFFER WET JET, available from The Procter & Gamble Company, Cincinnati, Ohio, United States.

The dispensing system 10 can comprise a liquid conduit 30 that discharges floor treatment composition from the dispensing package 15 to the floor. The terminal end or ends of the liquid conduit 30 can include a nozzle 35 to form a spray of the floor treatment composition as the floor treatment composition is discharged from the device 1. The outlet of the liquid conduit 30 or optional nozzle 35 can be designed to discharge the floor treatment composition 50 a distance from 0.05 m to about 1 m in front of the mop head 20. The conduit 30 can be flexible plastic tubing having an interior diameter from about 1 mm to about 5 mm and formed from a material such as TYGON, polyethylene, polypropylene, vinyl, or the like. The nozzle 35 can be a conical nozzle.

The dispensing system 10 can comprise a manual or electromechanical pump to pump the floor treatment composition from the dispensing package 15. Optionally, the floor treatment composition may be fed by gravity. The handle 5 can comprise a trigger for the manual pump, valve for a gravity feed, or electric switch 3 that is part of an electrical circuit connected to an electromechanical pump. The user can choose when to apply floor treatment composition at his or her discretion or as instructed.

Figure 2:
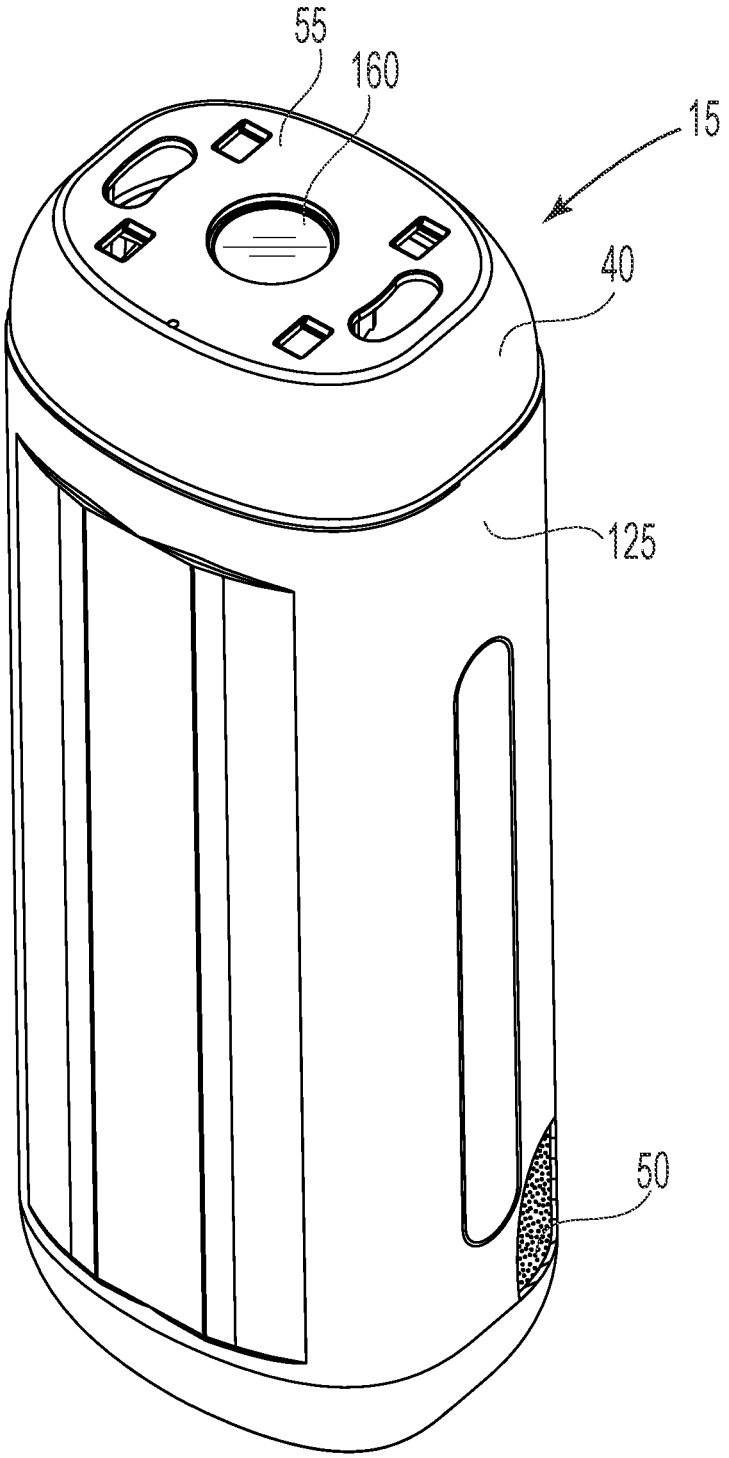
FIG. 2 is a container and a coupling shell together forming a dispensing package.

A dispensing package 15 is shown in FIG. 2. The dispensing package 15 can comprise a coupling shell 40 and a container 125. The coupling shell 40 can comprise features for helping the user align and fit the coupling shell 40 securely to a device, by way of nonlimiting example device 1. The coupling shell 40 can comprise features for helping the user align and fit the dispensing package 15 securely to the device 1. The container 125 contains the floor treatment composition 50. To use the dispensing package 15 shown in FIG. 2, the user positions the dispensing package 15 so that the coupling shell 40 is oriented towards the floor and fits the dispensing package 15 into the dispensing system 10. The open end of the container 125 can have a sealing surface and a membrane seal 160 can be engaged with sealing surface. The membrane seal 160 can be recessed relative to the top wall 55 of the coupling shell 40 to help protect the membrane seal 160 from being unintentionally breached.

Figure 3:
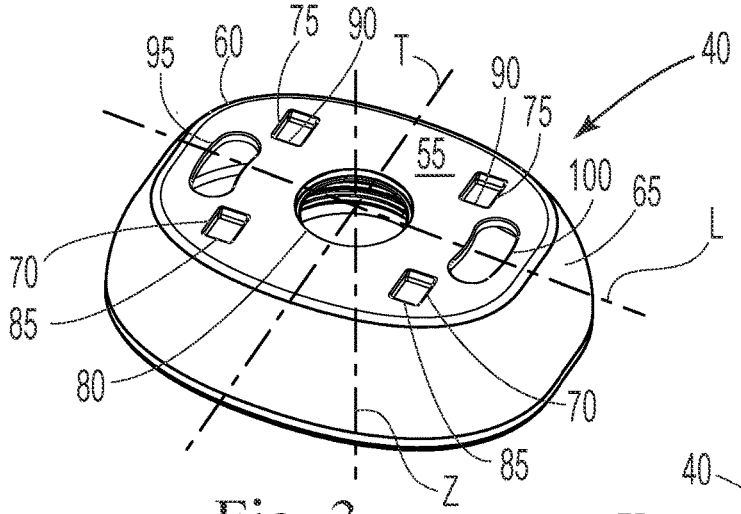
FIG. 3 is a top perspective view of a coupling shell.

The coupling shell 40 can be a molded plastic part. The coupling shell 40 can be an interface between the container 125 and other components of the dispensing system 10. The coupling shell 40 can comprise a top wall 55 (FIG. 3). The top wall 55 can be generally oriented towards the floor when floor treatment composition 50 is being dispensed. The top wall 55 can have a top wall periphery 60. The top wall periphery 60 can bound the top wall 55 to define the bounds of the top wall 55 and the boundary between the top wall 55 and the shell wall 65. The shell wall 65 can extend from the top wall periphery 60. Together, the top wall 55 and the shell wall 65 can partially define a shell interior.

The top wall 55 can have a longitudinal axis L, a transverse axis T orthogonal to the longitudinal axis L and intersecting the longitudinal axis L at a z-axis Z. The z-axis Z can be orthogonal to the longitudinal axis L and the transverse axis T. The top wall 55 can be substantially planar to provide a broad surface to support the dispensing package 15 when the dispensing package 15 is stored or displayed on a shelf in a position in which the coupling shell 40 rests on the shelf. The top wall 55 can be more extensive along the longitudinal axis L than along the transverse axis T.

The coupling shell 40 can comprise a front aperture 70 in the top wall 55. Optionally, the coupling shell 40 can comprise a pair of front apertures 70 in the top wall 55. Optionally, the coupling shell 40 can comprise a pair of front apertures 70 in the top wall 55 on one side of the longitudinal axis L. Optionally, each of the pair of front apertures 70 can be positioned on opposite sides of the transverse axis T. That is, the transverse axis T can be between each of the front apertures 70. The coupling shell 40 can further comprise a pair of rear apertures 75 in the top wall 55. Each of the pair of rear apertures 75 can be positioned on opposite sides of the transverse axis T with the longitudinal axis L between the front apertures 70 and the rear apertures 75. The transverse axis T can be between each of the rear apertures 75. The front apertures 70 and the rear apertures 75 arranged as such are spaced apart from one another, one aperture being in each of the four quadrants defined by the longitudinal axis L and the transverse axis T. These spaced apart apertures provide a location for one or more latches to engage with the coupling shell 40 to engage the dispensing package 15 within the dispensing system 10, and thereby to the device 1.

Parts of the front apertures 70 and parts of the rear apertures 75 can be in line with one another in a direction parallel to the transverse axis T. Such an arrangement can provide for symmetry or substantial symmetry in the force distribution in the top wall 55 of the coupling shell 40 when the dispensing package 15 is engaged within the dispensing system 10 and the device 1 is being manipulated across the floor by the user. Having symmetry in force distribution in the top wall 55 can simplify structural design of the coupling shell 40 and molding of the coupling shell 40 since thickness of the coupling shell 40 can be set to the minimum thickness required to operate under the maximum stress.

To provide for a pathway for the floor treatment composition 50 to be transported from within the container 125 to outside the container 125, the top wall 55 can be open at the z-axis Z. By way of nonlimiting example, a dispensing opening 80 can be provided in the top wall 55 and aligned with the z-axis Z. Providing the dispensing opening 80 aligned with the z-axis Z can provide for symmetry or substantial symmetry in the force distribution in the top wall 55 when the dispensing package 15 is engaged with the device 1 and the device is being manipulated across the floor by the user. The dispensing opening 80 can be a dispensing aperture entirely bounded by the top wall 55.

The front apertures 70 can each have a front edge 85 oriented away from the longitudinal axis L. The front edges 85 can be equidistant from the longitudinal axis L. Similarly, the rear apertures 75 can each have an inward edge 90 oriented towards the longitudinal axis L. The inward edges 90 can be equidistant from the longitudinal axis L. Such arrangements can provide for uniform loading of the top wall 55 during use, which can simplify structural design and molding of the coupling shell 40.

Each of the front apertures 70 and the rear apertures 75 can be equidistant from the z-axis Z. Such an arrangement can provide for symmetry or substantial symmetry in the force distribution in the top wall 55 when the dispensing package 15 is engaged with the device 1 and the device is being manipulated across the floor by the user, which may simplify structural design of the coupling shell 40.

The dispensing package 15 can further comprise a first guide aperture 95 and a second guide aperture 100 in the top wall 55 positioned along the longitudinal axis L and positioned on opposite sides of the transverse axis T. Each of the front apertures 70 and rear apertures 75 can be nearer to the transverse axis T than the first guide aperture 95 and the second guide aperture 100 are to the transverse axis T. The first guide aperture 95 and second guide aperture 100 can extend further away from the z-axis Z than the front apertures 70 and rear apertures 75. Positioning the first guide aperture 95 and second guide aperture 100 as such can provide for a more spatially compact location to attach the dispensing package 15 to the device 1 via one or more of the front apertures 70 and rear apertures 75. Such an arrangement also places front apertures 70 and rear apertures 75 nearer to the neck of the container 125 to provide a better transfer of force from the latches to the neck of the container 125 to provide for a leak resistant connection.

The first guide aperture 95 and the second guide aperture 100 can each be larger in area than individual front apertures 70 and individual rear apertures 75. This can be practical in that the guide apertures can provide for a large fraction of the resisting forces that stabilize the dispensing package 15 within its fit within the dispensing system 10 compared to the latches of the dispensing system 10 that can fit to one or more of the front apertures 70 and rear apertures 75. Moreover, the latches of the dispensing system 10 may be moveable and moveable structures fabricated from plastic may not be as durable as male shaped molded plastic parts that not moveable relative to the material from which they extend.

The front apertures 70 and rear apertures 75 can be outboard of the first guide aperture 95 and the second guide aperture 100 relative to the longitudinal axis L. The front apertures 70 and rear apertures 75 can extend further away from the longitudinal axis L than the first guide aperture 95 and the second guide aperture 100. This can provide for torque resistance to rotational movement of the longitudinal axis L of the top wall 55 above and beyond that provided for by the first guide aperture 95 and the second guide aperture 100. The front apertures 70 and the rear apertures 75 can be outboard of the first guide aperture 95 and the second guide aperture 100.

The first guide aperture 95 and the second guide aperture 100 can have a greater width measured orthogonal to the longitudinal axis L than length measured along the longitudinal axis L. Users of the device 1 are thought to tend to move the device forward and backward more vigorously than side to side. The forces generated by accelerating and decelerating the dispensing package 15 in this manner must be transferred to the device 1. Guide apertures having a width greater than the length can accommodate a guide fitted into the guide apertures that also has a width greater than the length and can provide for improved shear resistance in the transverse direction.

The coupling shell 40 can be more extensive along the longitudinal axis L than along the transverse axis T. The top wall 55 can have a rotational symmetry of order two about the z-axis Z. This can help the user appropriately align and engage the dispensing package 15 within the dispensing system 10 so that the first guide aperture 95 and the second guide aperture 100 are able to be appropriately engaged with the guides fitted thereto and the front apertures 70 and rear apertures 75 are able to be appropriately engaged with the latches.

The coupling shell 40 can comprise a dispensing opening 80 aligned with the z-axis Z. The dispensing opening 80 can provide for an opening in the coupling shell 40 through which the neck of the container 125 can be engaged with the device 1. Providing the dispensing opening 80 aligned with the z-axis Z is practical in that other portions of the top wall 55 away from the z-axis Z can be used to engage the coupling shell 40 with the device 1. Moreover, the guide apertures can be distributed around the dispensing opening 80 to stabilize the location of the dispensing opening 80 relative to other parts of the dispensing system 10.

The dispensing opening 80 can have a scalar open area. The scalar open area of the dispensing opening 80 is a scalar quantity having units of length squared. The scalar open area of the dispensing opening 80 is measured as the area of the dispensing opening 80 measured orthogonal to the z-axis Z. To protect the membrane seal from damage during transport and storage of the dispensing package 15, the dispensing opening 80 in can have a smaller scalar open area than the neck fitment beneath the top wall 55. The scalar open area of the neck fitment is a scalar quantity having units of length squared. The scalar open area of the neck fitment, which is bounded by the neck fitment, is measured orthogonal to the z-axis Z. Arranged as such, when the coupling shell 40 is fitted to the neck of the container 125, the membrane seal can be recessed relative to top wall 55 which can reduce the potential for the membrane seal being unintentionally punctured during transport and storage of the dispensing package 15.

Individual front apertures 70 and individual rear apertures 75 can have a scalar open area from about 4 $mm^2$ to about 100 $mm^2$. The scalar open area of the front apertures 70 and rear apertures 75 is measured orthogonal to the z-axis Z. The scalar open area of the dispensing opening 80 can range from about 50 $mm^2$ to about 1000 $mm^2$, optionally from about 100 $mm^2$ to about 500 $mm^2$. The dispensing opening 80 can be a circle, oval, or a polygon. The first guide aperture 95 and the second guide aperture 100 can individually each have a scalar open area from about 4 $mm^2$ to about 500 $mm^2$, optionally from about 50 $mm^2$ to about 200 $mm^2$. The front apertures 70 and rear apertures 75 can be rectangularly shaped with the short edges parallel to the longitudinal axis L. The front apertures 70 and rear apertures 75 can be square shaped having two edges parallel to the longitudinal axis L and two edges perpendicular to the longitudinal axis L. The guide apertures can have an individual scalar open area from about 50 $mm^2$ to about 300 $mm^2$. The guide apertures can have a combined scalar open area from about 50 $mm^2$ to about 300 $mm^2$. The guide apertures combined scalar open area can be from about 50% to about 200% of the combined scalar open area of the front apertures 70 and rear apertures 75. The guide apertures can be bean shaped, kidney shaped, rectangular, square, oval, elongated oval, or other shape.

The container 125 can have a volume from about 0.1 L to about 5 L, optionally from about 1 L to about 3 L. The dispensing package 15 can have a ratio of the volume of the container 125 to the combined scalar open area of the first guide aperture 95 and the second guide aperture 100 from about 1 L/$mm^2$ to about 1 L/100 $mm^2$. Such an arrangement can assist users with fitting the dispensing package 15 into the device 1. The dispensing package 15 can have a ratio of volume of the container 125 to the combined scalar open area of the front apertures 70 and rear apertures 75 from about 0.05 L/$mm^2$ to about 1 L/500 $mm^2$. Such an arrangement can help provide for a secure connection between the dispensing package 15 and the device 1 via the latch or latches.

Figure 4:
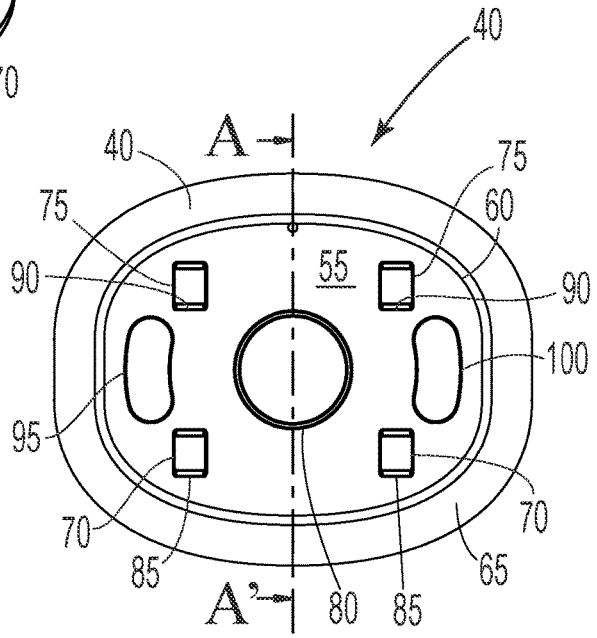
FIG. 4 is top view of a coupling shell.

The combined scalar open area of the front apertures 70 and rear apertures 75 as measured in a plane defined by the longitudinal axis L and transverse axis T can be from about 20% to about 70%, optionally from about 30% to about 50%, optionally about 40%, of the scalar open area of the dispensing opening 80 as measured in a plane defined by the longitudinal axis L and transverse A top view of the coupling shell 40 is shown in FIG. 4. The front edges 85 and inward edges 90 of the front apertures 70 and rear apertures 75 can be oriented in the same direction. At least part of the front edges 85 can be beveled relative to the top wall 55. Similarly, at least part of the inward edges 90 of the rear apertures 75 can be beveled relative to the top wall 55. Beveling the front edges 85 and or inward edges 90 can allow a latch to be guided into the respective aperture which can set up a proper fitting of the dispensing package 15 within the dispensing system 10. The top wall 55 can be beveled at least partially around the front apertures 70 and rear apertures 75. Beveling the front edges 85 and or inward edges 90 can also provide a reaction surface that transfers force applied to the top wall 55 in the z-axis Z direction into force applied to a latch in a direction substantially parallel to a plane defined by the longitudinal axis L and the transverse axis T to move the latch laterally in translation.

Each of the front edges 85 can have substantially the same shape. Each of the inward edges 90 can have substantially the same shape. The front apertures 70 and rear apertures 75 can be equidistant from the longitudinal axis L. Such arrangements individually or in combination can provide for substantially uniform loading of top wall 55 by the latches engaged therewith.

Figure 5:
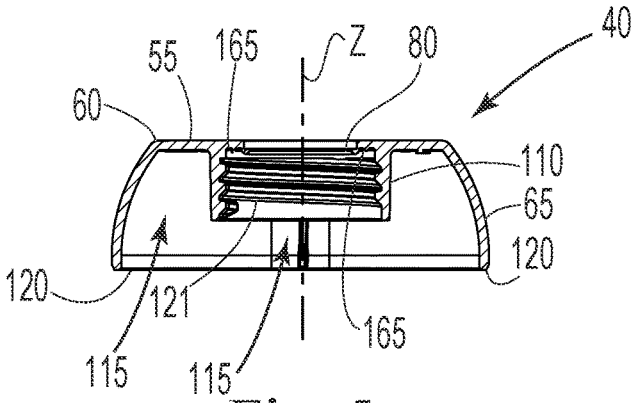
FIG. 5 is a cross section of the coupling shell of FIG. 4 as marked A-A'.

The coupling shell 40 can further comprise a neck fitment 110 surrounding or partially surrounding the dispensing opening 80 and projecting from the top wall 55 into the shell interior 115 and aligned about or partially about the z-axis Z (FIG. 5). The neck fitment 110 be a snap on or threaded neck fitment 110 comprising a snap ring or thread 121 that cooperates with a thread or bead on the neck of the container 125 to engage the neck fitment 110 with the neck of the container 125. The neck fitment 110 can be a threaded neck fitment 110 having threads that complementarily fit with threads on the neck of the container 125 to engage the neck fitment 110 with the neck of the container 125. Optionally, the neck fitment 110 can be a bayonet neck fitment 110 that complementarily fits with the neck of the container 125 to engage the neck fitment 110 with the neck of the container 125.

The shell wall 65 can extend in a direction along the z-axis Z further than the neck fitment 110. This arrangement can provide for space for guides to protrude through the first guide aperture 95 and second guide aperture 100 without the shoulder of the container 125 interfering with the fit of the guides in the guide apertures. Moreover, the shell wall terminal periphery 120 can be configured to be partially or entirely in contact with the shoulder of the container 125 to support or partially support the container 125 at or near the shoulder when the container 125 is inverted.

The neck fitment 110 can further comprise a land seal 165 that can be engaged with the membrane seal of the container 125. The land seal 165 can be a portion of the top wall 55 that is oriented towards the shell interior 115 that is raised relative to adjacent portions of the top wall 55 oriented towards the shell interior 115. The land seal 165 can be a continuous or discontinuous rib around the z-axis Z that protrudes from the top wall 55 in a direction oriented towards the shell interior 115. The land seal 165 can pinch the membrane seal between the land seal 165 and the sealing surface of the container 125. The land seal 165 can help ensure that the membrane seal of the container 125 does not pull away from the sealing surface of the container 125 when the membrane seal is pierced.

The coupling shell 40 can be a molded plastic part, the structure of which has a thickness from about 0.5 mm to about 10 mm. The constituent material of the coupling shell 40 can be a polyethylene terephthalate, low density polyethylene, high density polyethylene, polyvinyl chloride, polypropylene, polystyrene, polycarbonate, polylactide, acrylic, acrylic, acrylonitrile butadiene, styrene, fiberglass, nylon, or similar plastic material that can be formed into a coupling shell. The coupling shell 40 can be paperboard part, molded paperboard part, or cast paperboard part.

Figure 6:
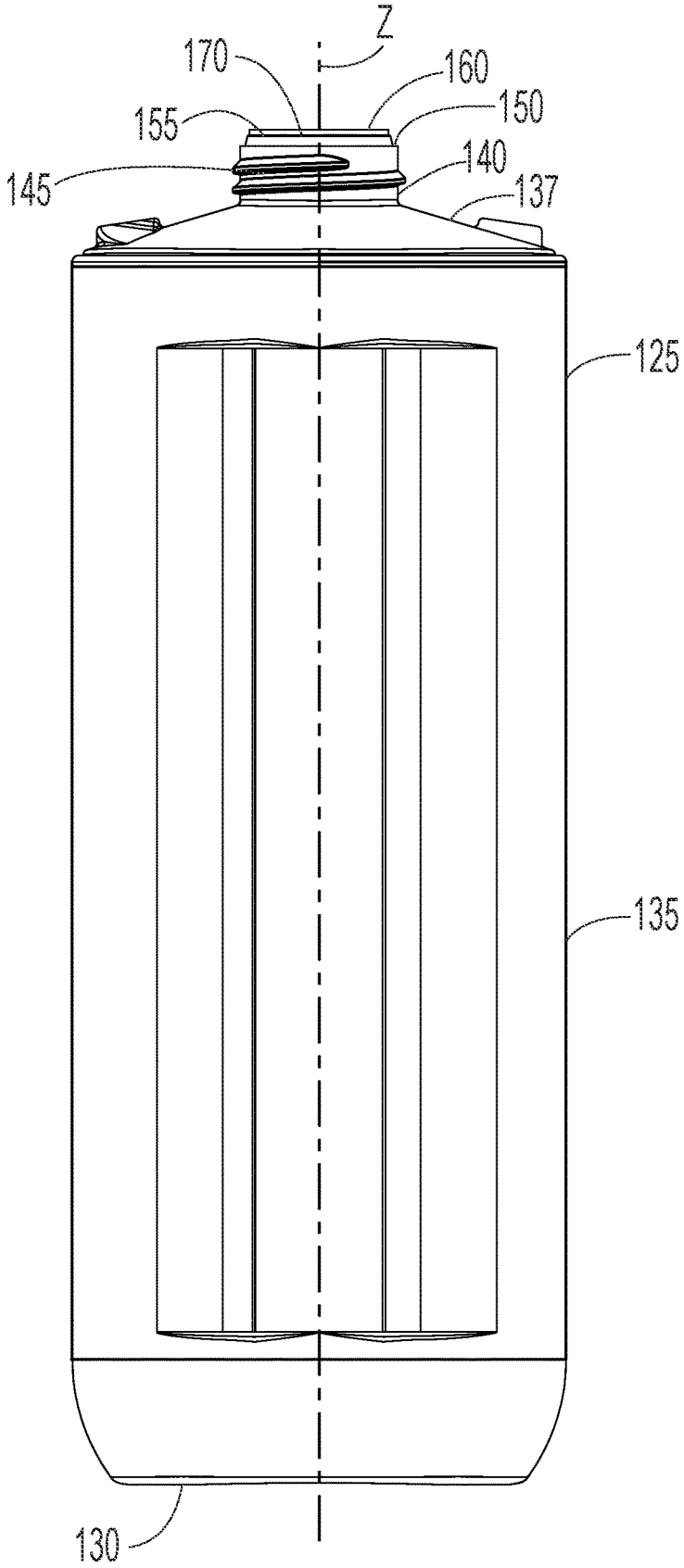
FIG. 6 is a container.

The dispensing package 15 can further comprise a container 125 (FIG. 6). The container 125 can comprise a base 130, a body wall 135 extending from the base 130 towards the coupling shell 40 and around the z-axis Z, a shoulder 137 extending from the body wall 135 to a neck 140 that extends around the z-axis Z, a finish 150 that extends around the z-axis and extends from the neck 140 to a sealing surface 155 that extends around the z-axis, and a membrane seal 160 engaged with the sealing surface 155. The neck fitment 110 can be engaged with the neck 140.

The base 130 can be configured so that the base 130 of the container 125 can rest on a horizontal surface without further support. The base 130 can include a push up or a fluted structure to provide for strength, improved stability, or the practical capability to mold the container 125. The body wall 135 surrounds a majority of the storage volume of the container 125. The shoulder 137 marks the transition from the body wall 135 to the neck 140 in which the shape of the container 125 is tapered at the neck 140 relative to the body wall 135.

The neck 140 of the container 125 can comprise a thread or bead 145 projecting away from the z-axis Z and extending around or partially around the z-axis Z and the neck fitment 110 can be engaged with the thread or bead 145. The thread or bead 145 can provide for a reaction surface to which a snap ring or thread 121 of the of the neck fitment 110 can be fitted. The thread or bead 145 on the neck 140 can resist displacement along the z-axis Z of the neck fitment 110 relative to the neck 140. The neck fitment 110 can be engaged with the thread or bead 145 on the neck 140. Together, the snap ring or thread 121 of the neck fitment 110 and the thread or bead 145 on the neck 140 can engage the neck fitment 110 with the container 125. The neck 140 of the container 125 can comprise a thread or threads that complementarily fit with a thread or threads on the neck fitment 110 to engage the neck fitment 110 with the container 125 by rotating the neck 140 and neck fitment 110 relative to one another.

The container 125 can be a thin-walled plastic vessel or pulp or pulp based vessel or lined pulp vessel. The container 125 can be a blow molded, injection molded, injection blow molded, or other molded vessel. The container 125 can have an open end 170 bounded by the sealing surface 155. The open end 170 can have a scalar open area from about 50 $mm^2$ to about 2000 $mm^2$, optionally from about 100 $mm^2$ to about 1000 $mm^2$.

The constituent material of the container 125 can be pulp, polyethylene terephthalate, low density polyethylene, high density polyethylene, polyvinyl chloride, polypropylene, polystyrene, polycarbonate, polylactide, acrylic, acrylic, acrylonitrile butadiene, styrene, fiberglass, nylon, or similar plastic material that can be formed into a container 125. The container 125 can be a paperboard part, molded paperboard part, or cast paperboard part and optionally include an interior bladder or film liner fabricated from a polymeric material or even a biodegradable polymeric material.

The membrane seal 160 can be an elastomeric membrane. The membrane seal 160 can be silicone or even a single layer of silicone. Optionally, the membrane seal 160 can be a laminate of silicone and polyethylene terephthalate. The surface of the membrane seal 160 oriented towards the interior container 125 can be polyethylene terephthalate so as to provide for chemical compatibility between the membrane seal 160 and the contents of the container 125. The membrane seal 160 can be an elastomeric membrane. The membrane seal 160 can have a thickness less than 5 mm, optionally less than 3 mm, optionally less than 2 mm, optionally less than 1 mm. The membrane seal 160 can have a shape that can cover the sealing surface 155 of the container 125 and the open end 170 of the container 125. The membrane seal 160 can have a circular shape and the sealing surface 155 of the container can be a circular annulus likewise. The membrane seal 160 can be joined to the sealing surface 155 by heat sealing, gluing, welding, or other technique, by way of nonlimiting example.

Figure 7A:
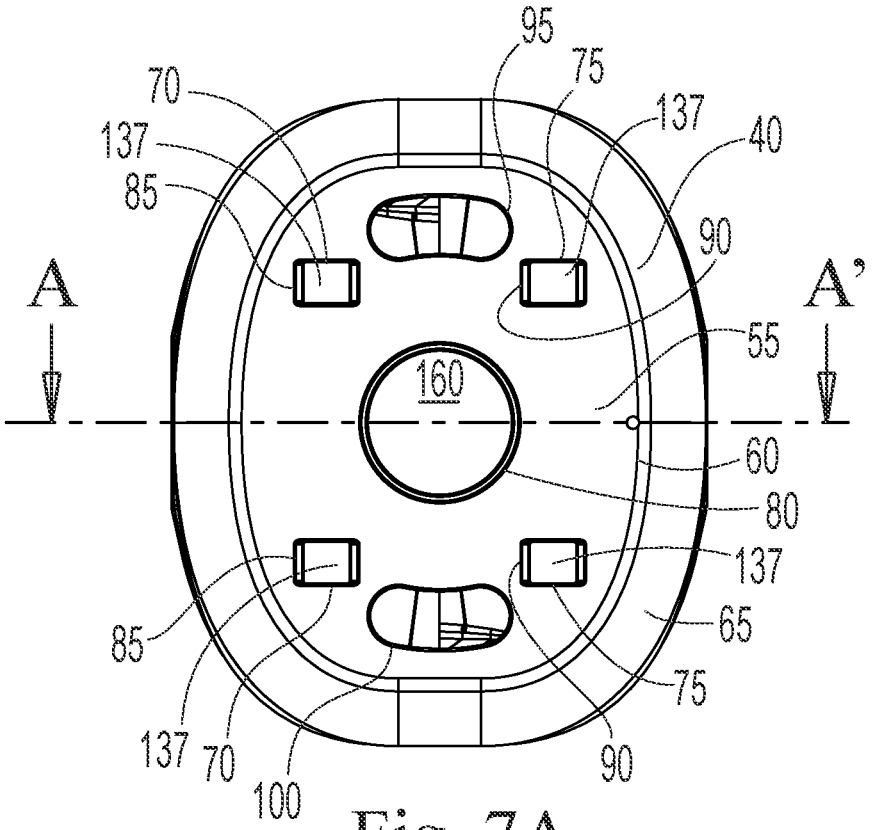
FIG. 7A is a top view of a coupling shell engaged with a container.
Figure 7B:
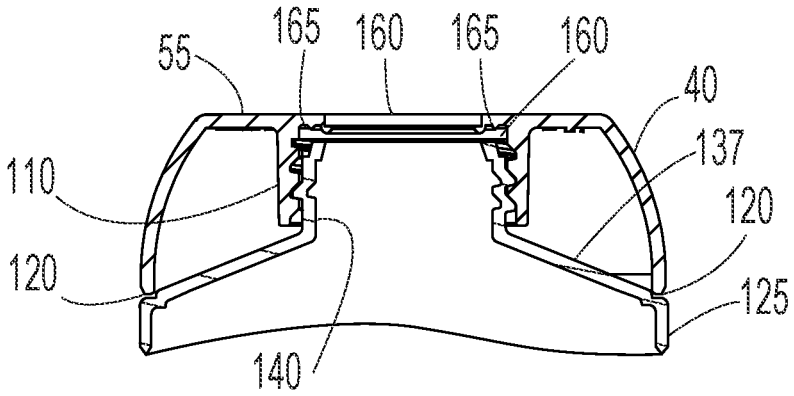
FIG. 7B is a cross section of the coupling shell engaged with the container in FIG. 7A as marked A-A'.

When the coupling shell 40 is assembled with the container 125, the top wall 55 of the coupling shell 40 can be spaced apart from the shoulder 137 of the container 125 (FIG. 7A, 7B). Such an arrangement can provide for space in the dispensing package 15 for accommodating guides that can protrude through the first guide aperture 95 and second guide aperture 100. The guides can provide a cue to the user on how to appropriately orient the dispensing package 15 in the device 1 and optionally provide for some mechanical engagement between the guides and the top wall 55 of the coupling shell 40.

Figure 8:
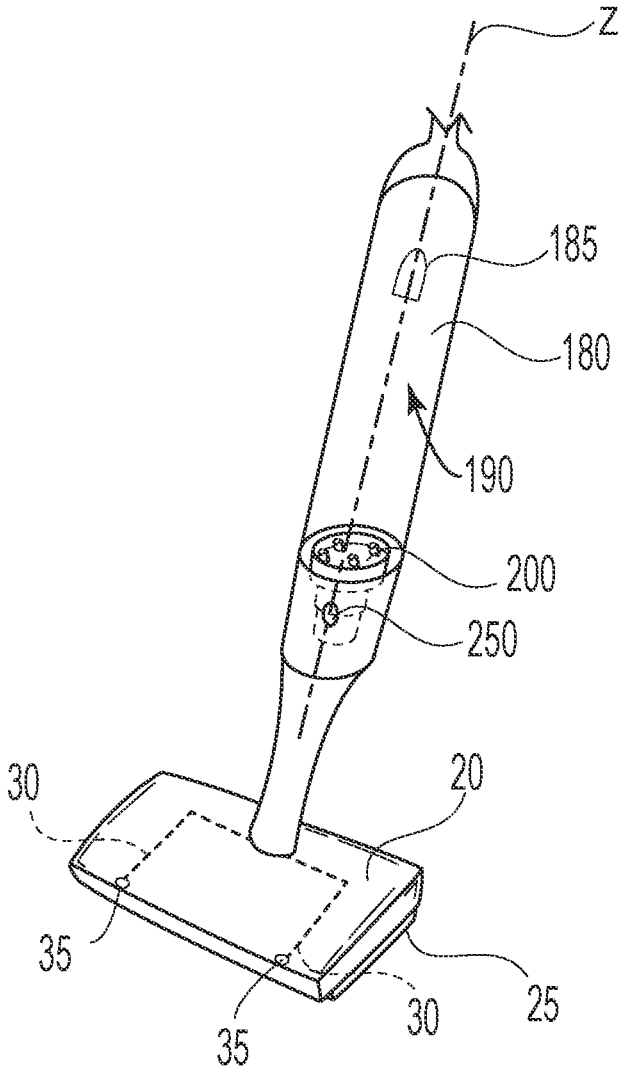
FIG. 8 is a device for cleaning or treating a floor.

A dispensing system 10 is shown in greater detail in FIG. 8. The dispensing system 10 can comprise a housing 180 partially enclosing a cavity 190. The cavity 190 can be sized and dimensioned to receive the dispensing package 15. The cavity 190 can be aligned with the z-axis Z. The housing 180 can be open towards the front of the device 1 so that the dispensing package 15 can be inserted into and removed from the cavity 190 from the front of the dispensing system 10. An opening 185 can be provided in the rear of the cavity 190 so that the user can push the dispensing package 15 out of the front of the cavity 190 from the rear. The housing 180 can be between the handle 5 and the mop head 20.

The dispensing system 10 can further comprise a cradle 200 moveable within the housing 180 along the z-axis Z from a first position, by way of nonlimiting example as illustrated in FIG. 8, to a second position. The cradle 200 can be sized and dimensioned to hold the dispensing package 15 in the proper rotational position about the z-axis Z so that the floor treatment composition 50 within the dispensing package 15 can be delivered to the mop head 20.

In the first position without a dispensing package 15 mounted in the cavity 190, the cradle 200 can present a molded surface to the user that is absent of sharp protrusions or sharp edges, by way of nonlimiting example as shown in FIG. 8. The appurtenances for placing the floor treatment composition 50 that is within the dispensing package 15 in fluid communication with the mop head 20 can be shielded from contact by the user by the cradle 200. When the cradle 200 is moved into the second position, the floor treatment composition 50 within the dispensing package 15 can be fluid communication with the mop head 20. To release the dispensing package 15 from the dispensing device 10, the user can push a button 250 towards the z-axis Z, which in turns slides a frame having appurtenances that latch onto the dispensing package 15 in some manner into a position in which the appurtenances are disengaged from the dispensing package 15. The cradle 200 then can move or be moved from the second position back to the first position and the dispensing package 15 can be removed from the dispensing device 10.

After inserting the dispensing package 15 into the cavity 190, the user can push the dispensing package 15 downward. By pushing the dispensing package 15 downward, the cradle 200 is forced into the second position.

Figure 9:
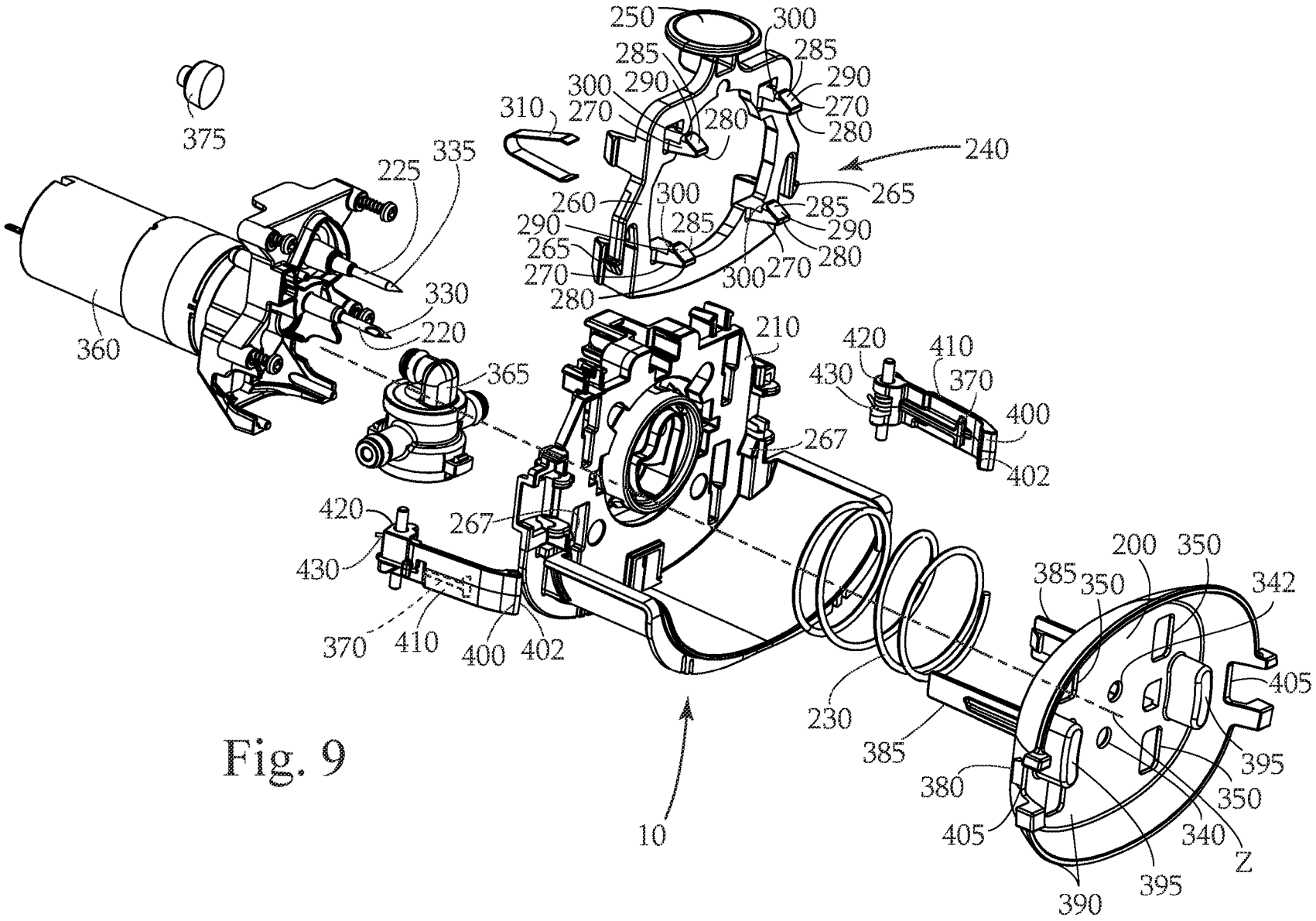
FIG. 9 is an exploded view of a dispensing system.

An exploded view of the components positioned within the housing 180 is shown in FIG. 9. A chassis 210 can be supported in a fixed position along the z-axis Z within the housing 180. The chassis 210 is a framework that supports the various appurtenances for providing fluid communication between the floor treatment composition 50 within the dispensing package 15 and the mop head 20. The chassis 210 can further mechanisms for securing the dispensing package 15 to the device 1.

The chassis 210 can support an inlet cannula 220 that is shielded from the user when the cradle 200 is in the first position and protrudes through the cradle 200 when the cradle 200 is in the second position. The inlet cannula 220 can provide the liquid transport pathway for the floor treatment composition 50 from within the dispensing package 15 to be delivered to the mop head 20.

The chassis 210 can be engaged with the housing 180 at a fixed position along the z-axis Z. A cradle spring 230 can be engaged with the cradle 200 and positioned between the cradle 200 and the chassis 210. The cradle spring 230 can provide for an upward driving force to disengage the dispensing package 15 from the inlet cannula 220 when a release mechanism is actuated.

When the user inserts the dispensing package 15 into the cavity 190, the cradle spring 230 can have a first stored energy that is zero or greater. The user can then push the dispensing package 15 downward to move the cradle 200 from the first position to the second position. As the cradle 200 moves downward, energy can be stored in the cradle spring 230 so that in the second position the cradle spring 230 has a second stored energy that is greater than the first stored energy. When a cradle release mechanism is actuated, the energy stored in the cradle spring 230 moves the cradle 200 up above the inlet cannula 220 and the dispensing package 15 is disengaged from the inlet cannula 220.

A sliding lock 240 can be slidingly engaged with the chassis 210. The sliding lock 240 can be reciprocatingly movable relative to the z-axis Z at a fixed position along the z-axis Z through a range of motion. The user can engage the sliding lock 240 with the dispensing package 15 by inserting the dispensing package 15 into the cavity 190 and the pushing the dispensing package 15 down thereby moving cradle 200 from the first position to the second position.

The sliding lock 240 can comprise a button 250, by which the sliding lock 240 can be disengaged from the dispensing package 15 by pushing on the button 250. The button 250 can be oriented in a direction away from the z-axis Z. The button 250 can be operatively positioned so that the user can manually manipulate the position of the sliding lock 240 relative to a fixed position along the z-axis Z. The button 250 can be an intended user contact surface of the sliding lock 240.

The sliding lock 240 can comprise an open frame 260 engaged with or extending from the button 250. The open frame 260 is open in line with the z-axis Z through the intended range of motion of the open frame 260. The open frame 260 provides for space through which the inlet cannula 220 and optional vent cannula can protrude so that when the cradle 200 is in the second position, the inlet cannula 220 and optional vent cannula can protrude through cradle 200 to engage with the dispensing package 15. The button 250 can be integral with the open frame 260, i.e. molded as a single continuous part, or can be attached to the open frame 260. The button 250 can provide for an ergonomic surface that a user can press to manually manipulate the position of the open frame 260.

A plurality of latches 270 can extend from the open frame 260. Each latch 270 can extend from the open frame 260 in a direction towards the cradle 200 to a free end 280. One or more of the latches 270 can catch on a portion of the dispensing package 15 to hold the dispensing package 15 in place while the device 1 is in use.

Each of the latches 270 can have a catch side 290 oriented towards the button 250 and a catch surface 300 oriented towards the open frame 260. The catch side 290 refers to the side of the latch 270 from which the catch surface 300 depends. The catch surface 300 acts to catch on a portion of the dispensing package 15 to hold the dispensing package 15 in place when the device 1 is being used. The catch surface 300, when engaged with the dispensing package 15, can provide a force or component of force on the dispensing package 15 that is generally aligned with the z-axis Z in a direction towards the mop head 20. The catch surface 300 pulls on portion of the dispensing package 15 to maintain the dispensing package 15 in engagement with the inlet cannula 220 when the cradle 200 is in the second position. Providing the catch sides 290 oriented towards the button 250 is practical in the that pushing motion on the button 250 can disengage the latches 270 from the structure on with which they are engaged on the dispensing package 15. Pushing to disengage may be advantageous over pulling since users are thought to have better fine muscular control and stability pushing a button 250 than pulling on a tab or grip to disengage the latches 270. As the user pushes the button 250, a frame spring 310 can be loaded and once the cradle 200 moves towards the first position, the loaded stored energy can displace the open frame 260 back to its engaged position with the cradle 200 being above the latches 270 and the dispensing package 15 being able to easily be removed from the cavity 190. In this manner, the dispensing package 15 the force required to engage the latches 270 to the dispensing package 15 is applied by the frame spring 310 rather than the user. Spring applied force may be more controllable than user applied force which increase the likelihood that the latches 270 are appropriately engaged with the dispensing package 15.

The catch side 290 of the free end 280 of each latch 270 can have a beveled surface 285 oriented away from the open frame 260. The beveled surface 285 can help facilitate engagement of the dispensing container 15 with the latches 270. As the dispensing container 15 is pushed down and the cradle 200 transitions from the first position towards the second position, structure on the dispensing package 15 can push down on the latches 270. A beveled surface 285 on the free end 280 of latches 270 can transfer some of the applied vertical force laterally to slide the open frame 260 laterally to permit the latches 270 to grasp structure on the dispensing package 15, such as one or more of the front apertures 70 and or rear apertures 75. The front edges 85 of the front apertures 70 and the inward edges 90 of the rear apertures 75 may also be cooperatively beveled to transfer vertical force applied to the dispensing package 15 laterally to assist with translating the open frame 260. Such cooperatively beveled surfaces can help reduce the vertical force that the user needs to apply to the dispensing package 15 to move the open frame 260 into position so that the dispensing package 15 can be received and stably engaged by the latches 270 once the cradle 200 is in the second position. Moreover, the cooperative beveled surfaces guide proper fit of the dispensing package 15 with the latches 270 if these elements are in imperfect alignment. Providing the catch side 290 of the free end 280 of each latch 270 with a beveled surface 285 oriented away from the open frame 260 allows downward force on the dispensing package 15 to move the open frame 260 so that the latches 270 can be engaged with the dispensing package 15. Energy stored in the frame spring 310 can provide for movement of the open frame 260 so that lateral engagement of the latches 270 and the dispensing package 15 can occur. The cooperatively beveled surfaces can cam against one another.

The open frame 260 can have an engaged position and a disengaged position. The open frame 260 can be biased to be in the engaged position. The engaged position is a position in which if the cradle 200 is in the second position and a dispensing package 15 is installed so that the latches 270 extending from the open frame 260 are engaged with the dispensing package 15. The engaged position of the open frame 260 is the position in which the open frame 260 can tend to be when the cradle 200 is in the first position and the user is not pushing on the button 250. When the open frame 260 is in the engaged position, the button 250 can be further away from the z-axis Z than when the open frame 260 is in the disengaged position. In the engaged position, the latches 270 are positioned to catch a portion of the dispensing package 15 if the cradle 200 is in the second position and a dispensing package 15 is installed. To transition the open frame 260 from the engaged position to the disengaged position, the user can press on the button 250 to slide the open frame 260 partially across the z-axis Z, which moves the latches 270 to be in a position in which the latches 270 are not in a position to catch a portion of the dispensing package 15 if the cradle 200 is in the second position.

To bias the open frame 260 to be in an engaged position, the dispensing system 10 can further comprise a one-dimensional frame spring 310. The frame spring 310 can be biased to push on the open frame 260 in a direction away from the z-axis Z so that the open frame 260 is in the engaged position. To move the open frame 260 to the disengaged position, the user can push on the button 250 to displace the open frame 260. As the open frame 260 moves from the engaged position to the disengaged position, the frame spring 310 stores energy. Once the user stops pushing on the button 250, the frame spring 310 releases the stored energy to move the open frame 260 back to the engaged position. The frame spring 310 can have a compression or extension axis orthogonal to the z-axis Z. Biasing the open frame 260 to be in the engaged position can be practical for providing stable mechanical engagement between the dispensing package 15 and the dispensing system 10. Moreover, biasing the open frame 260 as such can require the user to provide some exertion to engage the dispensing package 15 within the dispensing system 10 and the user can sense if the engagement has occurred by feeling the change in force applied to the dispensing package 15 as the dispensing package 15 is engaged with the latches 270.

When no dispensing package 15 is installed and the cradle 200 is in the first position, the open frame 260 can be in the engaged position but the latches 270 are not engaged with the dispensing package 15. When the dispensing package 15 is installed in the cavity 190 and the cradle 200 is pushed down into the second position, the latches 270 can be engaged with the dispensing package 15. Pushing the button 250 can move the open frame 260 to a disengaged position that releases the dispensing package 15 from being captured by the latches 270 and the cradle spring 230 can push the cradle 200 up so that the user can easily remove the dispensing package 15 from the cavity 190.

The dispensing system 10 can further comprise a carriage stop 265 or pair of carriage stops 265 projecting outwardly from the open frame 260 in a direction away from, and optionally orthogonal to, the z-axis Z. Each carriage stop 265 can be engaged with an individual stop catch 267 engaged with or an integral part of the chassis 210. The carriage stop 265 can limit the range of reciprocal motion of the open frame 260 as it moves from the disengaged position to the engaged position. The carriage stops 265 can be integral with the open frame 260, i.e. as a single continuous molded part.

In operation, the user can remove the dispensing package 15 by pushing on the button 250. Pushing on the button 250 can translationally displace the open frame 260 to a disengaged position which thereby releases the latches 270 from engagement with the dispensing package 15. The user can then remove the dispensing package 15 from the dispensing system 10. When the user releases the button 250, the open frame 260 can translate back to an engaged position. But since there is no dispensing package 15 in the dispensing system 10, the latches 270 are not engaged with the dispensing package 15. The carriage stops 265 contacting the stop catches 267 limit the range of motion of the open frame 260 as the button 250 translates in direction away from the z-axis Z.

The inlet cannula 220 can project in a direction parallel to or in line with the z-axis Z through the open frame 260. The dispensing system 10 can comprise more than one inlet cannula 220, optionally two, or two or more inlet cannulae 220. The inlet cannula 220 can comprise an inlet cannula entrance 330. The inlet cannula entrance 330 is the open end of the inlet cannula 220 through which the floor treatment composition 50 is transported on its way to the mop head 20. The inlet cannula entrance 330 can be sharp so that it can pierce a membrane seal 160. The inlet cannula 220 can be a non-coring needle so that the membrane seal 160 is pierced by puncturing the membrane seal 160 and the membrane seal 160 remains in one piece. This is in contrast to a coring needle in which a core from the membrane seal 160 is separated or partially separated from the membrane seal 160 as needle is pushed through the membrane seal 160. A non-coring needle can be advantageous if the user engages and disengages the same dispensing package 15 with the dispensing system 10 multiple times since a membrane seal 160 pierced by a non-coring needle may be less prone to leakage after the needle is removed compared to when a coring needle is employed. Furthermore, a non-coring needle is unlikely to generate a piece of chaff from the membrane seal 160 as it pierces the membrane seal 160.

The inlet cannula 220 can be straight. The inlet cannula 220 can be formed of a metal, such as stainless steel, titanium, aluminum, and the like. The inlet cannula 220 can have an outside diameter from about 0.5 mm to about 5 mm, optionally about 1 mm to about 3 mm. The inlet cannula 220 can have in inside diameter from about 0.2 mm to about 3 mm, optionally from about 1 mm to about 3 mm. The inlet cannula entrance 330 can be a straight or beveled edge and can have a tip angle from about 0 degrees to about 30 degrees, optionally from about 10 degrees to about 20 degrees.

When the cradle 200 is in the first position, the inlet cannula entrance 330 can be between the chassis 210 and the cradle 200. This can shield the inlet cannula 220 when the cradle 200 is in the first position. The first position of the cradle 200 can occur when no dispensing package 15 is installed in the dispensing system 10 or before the dispensing package 15 is pushed down to engage the dispensing package 15 with the inlet cannula 220.

The cradle 200 can comprise a liquid transport aperture 340. The liquid transport aperture 340 can be aligned with the inlet cannula 220 so that the liquid transport aperture 340 is in registration with the inlet cannula 220. When the cradle 200 is in the second position, the inlet cannula entrance 330 can project through the cradle 200 at the liquid transport aperture 340 in the cradle 200. When a dispensing package 15 is installed in the dispensing system 10, the liquid transport aperture 340 can be in line with the dispensing opening 80 of the coupling shell 40. That can permit the inlet cannula 220 to protrude through the cradle 200 at the liquid transport aperture and through the dispensing opening 80 to pierce through the membrane seal 160 so the floor treatment composition 50 can be transported out of the dispensing package 15 to the floor.

The dispensing system 10 can optionally comprise a vent cannula 225 that projects in a direction parallel to the z-axis Z through the open from 260. The cradle 200 can further comprise a vent aperture 342. The vent aperture 342 can be aligned with the vent cannula 225. The vent cannula 225 can comprise a vent cannula outlet 335. When the cradle 200 is in the first position, the vent cannula outlet 335 can be between the chassis and the cradle 200 and aligned with a liquid transport aperture 340. When the cradle 200 is in the second position, the vent cannula 225 can protrude through the vent aperture 342. The vent cannula outlet 335 is the location at which air flow exits the vent cannula 225 during venting, that is exits into the dispensing package 15. The vent cannula 225 can provide for venting from the dispensing package 15 as floor treatment composition 50 is dispensed from the within the dispensing package 15. As floor treatment composition 50 flows out of the dispensing package 15, air can be vented into the dispensing package 15 to equalize the pressure within the dispensing package 15 and the ambient pressure of the environment in which the device 1 is used. A vent cannula 225 may not be required if pressure equalization is addressed otherwise, for example by providing a vent as part of the dispensing package 15 or containing the floor treatment composition 50 in a collapsible bag that collapses as the floor treatment composition 50 is dispensed therefrom. Optionally the inlet cannula 220 can have a vent integrated therein.

The vent cannula 225 can be in fluid communication with a one-way vent valve 375 open to fluid flow in a direction towards the vent cannula outlet 335. When a dispensing package 15 is installed in the dispensing device 10, the vent cannula outlet 335 can be within the container 125 of the dispensing package 15.

The cradle 200 can comprise a plurality of engagement apertures 350 aligned with the latches 270 so that the engagement apertures 350 are in registration with the latches 270. When the cradle 200 is in the first position, the cradle 200 is above the latches 270 so that the latches 270 are between the chassis 210 and the cradle 200. When the cradle 200 is transitioned to the second position, the cradle 200 is lowered relative to the chassis 210 and the latches 270 can protrude through the cradle 200. When a dispensing package 15 is engaged with the dispensing system 10 and the cradle 200 is in the second position, the latches 270 can latch onto a portion of the dispensing package 15.

The cradle 200 can further comprise a pair of spaced apart guides 395 protruding from the exterior facing surface 390 of the cradle 200. The guides 395 can be further away from the z-axis Z than the engagement apertures 350. The guides 395 can be outboard of the engagement apertures 350 and z-axis Z can be in line with and between the guides 395. The guides 395 can provide a protruding shape that can fit into or conform with a part of the dispensing package 15 when the dispensing package 15 is in the proper fitted position.

Optionally, the cradle 200 can further comprise a pair of spaced apart stems 385 protruding from the interior facing surface 380 of the cradle 200. These stems 385 can fit into and or through openings through the chassis 210 to help guide movement of the cradle 200 from the first position to the second position and stabilize the fit of the cradle 200 with the chassis 210.

The dispensing system 10 can further comprise a pump 360 in fluid communication with the inlet cannula 220. The pump 360 can pump the floor treatment composition 50 from the dispensing package 15 to the mop head 20. The mop head 20 can be in fluid communication the pump 360. The pump 360 can be connected to the mop head 20 via a conduit 30.

The pump 360 can be a manual piston pump 360 that is activated by a trigger that that is pulled or pushed repetitively to generate an upstroke and down stroke of the pump 360. The pump 360 can be an electromechanical pump 360 that is activated by a switch 3 mounted on the handle 5. The pump 360 can be, by way of nonlimiting example, a gear pump, an impeller pump, a piston pump, a screw pump, a peristaltic pump, a diaphragm pump, or any other pump that can fit within a small space having a volume less than 1 L. If an electromechanical pump 360 is employed, a power source can be on-board the device 1. The power source can be integrally molded into or attached to the dispensing system 10. The power source can be a rechargeable battery, a disposable battery, or a household alternating current connected to the device by a cord with an optional transformer. The pump 360 can provide a flow rated from about 20 mL/minute to about 400 mL/minute, optionally from about 150 mL/min to about 250 mL/min.

The dispensing system 10 can further comprise a check valve 365 downstream of the pump 360. The check valve 365 can be downstream of the pump 360 and upstream of the conduit 30. The check valve 365 can have a direction of permitted flow from the pump 360 to the conduit 30. The check valve 365 can help to prevent back flow into the pump 360 and also act to retain floor treatment composition 50 in the conduit 30 by way of development of a vacuum within the conduit 30 downstream of the check valve 365, which reduces the possibility of uncontrolled drips emanating from the conduit 30 when the pump 360 is not activated or the device is not in use.

The dispensing system 10 can comprise a pair of opposing cradle supports 370. The cradle supports 370 can be oriented towards the z-axis Z and be engaged with cradle interior facing surface 380 when the cradle 200 is in the first position. The cradle interior facing surface 380 is oriented towards the chassis 210. The cradle 200 can have an exterior facing surface 390 opposite the cradle interior facing surface 380. The cradle supports 370 can support the cradle 200 from beneath the cradle 200 when the cradle 200 is in the first position and resist movement of the cradle 200 from the first position towards the second position. The cradle 200 can be in the first position before a dispensing package 15 is installed in the dispensing system 10. Since the cavity 190 is open in that situation, a user might unintentionally contact the cradle 200 which might push the cradle 200 down towards the chassis 210. That might unintentionally result in the inlet cannula 220 protruding through the cradle 200 at the liquid transport aperture 340 and might result in the inlet cannula 220 and optional vent cannula 225 being contactable by the user.

Each of the cradle supports 370 can extend from an activation arm 400 that extends outboard of the peripheral edge 405 of the cradle 200 and over at least a portion of the exterior facing surface 390. The cradle supports 370 can extend from the activation arm 400 towards the z-axis Z to support the cradle 200 from beneath the cradle 200. When a dispensing package 15 is inserted into the cavity 190 and seated in the cradle 200, parts of the dispensing package 15 can push on the activation arms 400 to push the arm ends 402 of the activation arms 400 away from the z-axis Z. Movement of the arm ends 402 of the activation arms 400 away from the z-axis Z can disengage the cradle supports 370 from the interior facing surface 380 of the cradle 200. In effect, the dispensing package 15 can spread apart the activation arms 400 which in turn move the cradle supports 370 from beneath the cradle 200. That frees up the cradle 200 to be moved from the first position towards and to the second position.

Providing an activation arm 400 outboard of the peripheral edge 405 of the cradle 200 and over part of the exterior facing surface 390 can provide for a mechanism for disengaging the cradle supports 370 from the cradle 200 by default when the dispensing package 15 is seated in the cradle 200. The user does not have to manually manipulate a switch or lever or other mechanical or electromechanical device to disengage the cradle supports 370. Rather, the cradle supports 370 are disengaged by the user performing the intended action of installing a dispensing package 15 in the cradle 200. This simplifies operation of the dispensing system 10 by the user. Moreover, since the activation arms 400 are on opposite sides of the cradle 200, there is a low likelihood that a user will unintentionally disengage both cradle supports 370 simultaneously and be able to move the cradle 200 from the first position to the second position.

Each cradle supports 370 can be engaged with a lever arm 410 that is engaged with the chassis 210 at a hinge 420. Each hinge 420 can comprise a hinge spring 430 biased to rotate the lever arm 410 towards the z-axis Z. Supporting the cradle 200 in the first position with cradle supports 370 depending from lever arms 410 that are hingedly engaged with the chassis 210 can provide for simple repetitive disengagement and engagement of the cradle supports 370 from and to the cradle interior facing surface 380. Hinge springs 430 biased to rotate the lever arm 410 towards the z-axis Z can provide for automatic engagement of the cradle supports 370 with the cradle interior facing surface 380. The hinge spring 430 can be a coil spring in which one end is engaged with the chassis 210 and the other end is engaged with the lever arm 410 at or near the location where the lever arm 410 is connected to the hinge 420.

A mechanism for restraining unintentional movement of the cradle 200 from the first position to the second position that comprises a lever arm 410 extending from a hinge 420 engaged with the chassis 210 to an activation arm 400, wherein a cradle support 370 extends from the lever arm 410 at a position between the hinge 420 and the activation arm 400 in a direction towards the z-axis Z and is engaged with the cradle interior facing surface 380, wherein the activation arm 400 extends outboard of the peripheral edge 405 and over at least a portion of the cradle exterior facing surface 390, and wherein the hinge 420 comprises a hinge spring 430 biased to rotate the lever arm 410 towards the z-axis Z, can be simple for the user to operate since the cradle supports 370 can be disengaged from the cradle 200 by inserting a dispensing package 15 into the cavity 190 and fitting the dispensing package 15 to the cradle 200. A part of the dispensing package 15 can push the activation arms 400 in a direction away from the z-axis Z, which in turn move the cradle supports 370 from beneath the cradle 200 so that the cradle 200 is free to be pushed from the first position to the second position. The user does not even need to appreciate that the mechanism is present or how it works since the mechanism can operate automatically when the user inserts the dispensing package 15 into the cavity 190 as part of his or her anticipated use of the device 1.

Figure 10:
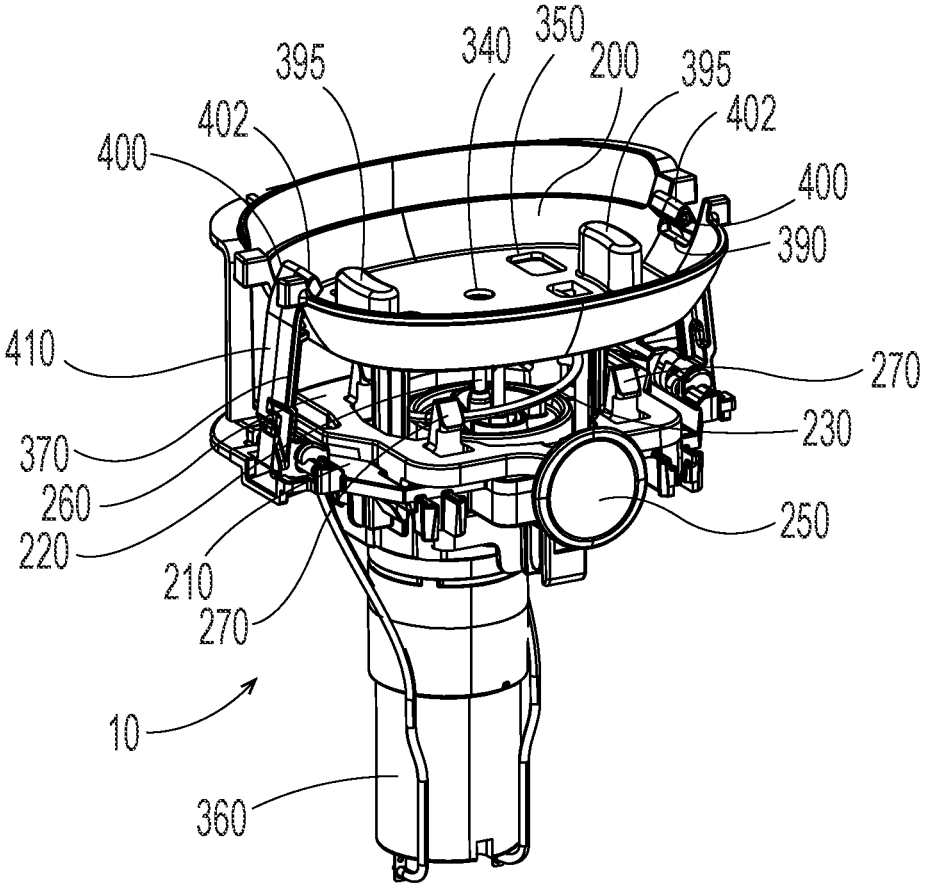
FIG. 10 is a dispensing system with the cradle in the first position.

An assembly of parts of the dispensing system 10 is shown in FIG. 10. In FIG. 10, the cradle 200 is in the first position. In the first position, the inlet cannula 220 is positioned between the cradle 200 and the chassis 210. That can limit the possibility that the user unintentionally touches the inlet cannula 220. Moreover, when the cradle 200 is in the first position, the activation arms 400 reach up and slightly over the exterior facing surface 390 of the cradle 200. Beneath the cradle 200, the cradle supports 370 are engaged with the interior facing surface 380 of the cradle 200, thereby resisting movement of the cradle 200 from the first position to the second position.

Figure 11A:
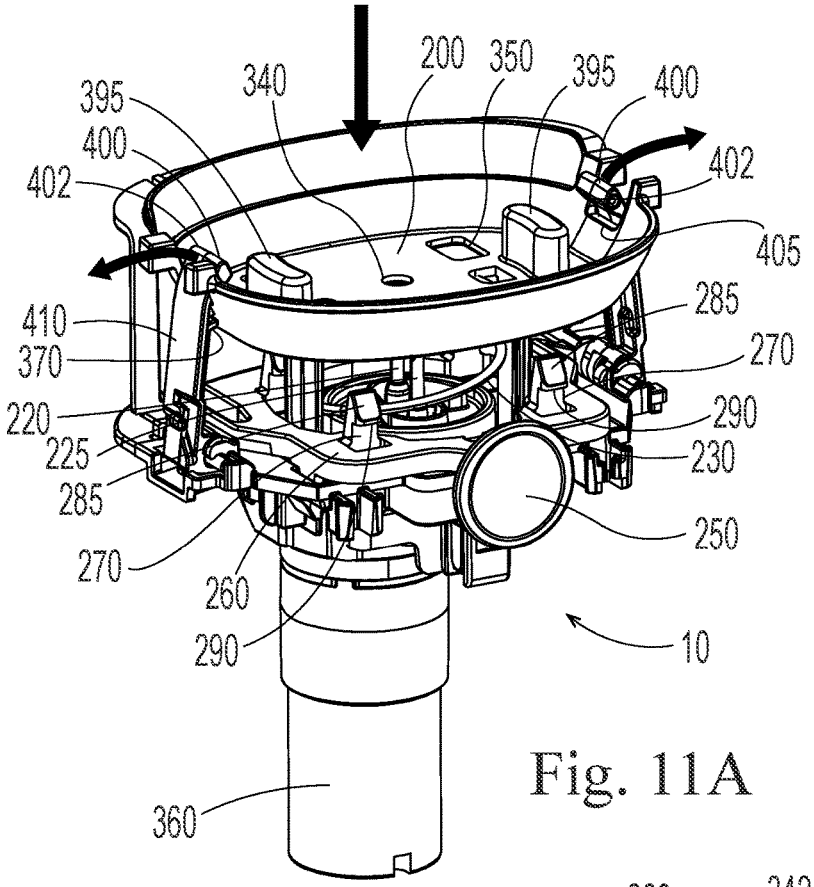
FIG. 11A is a dispensing system with the cradle in the first position.
Figure 11B:
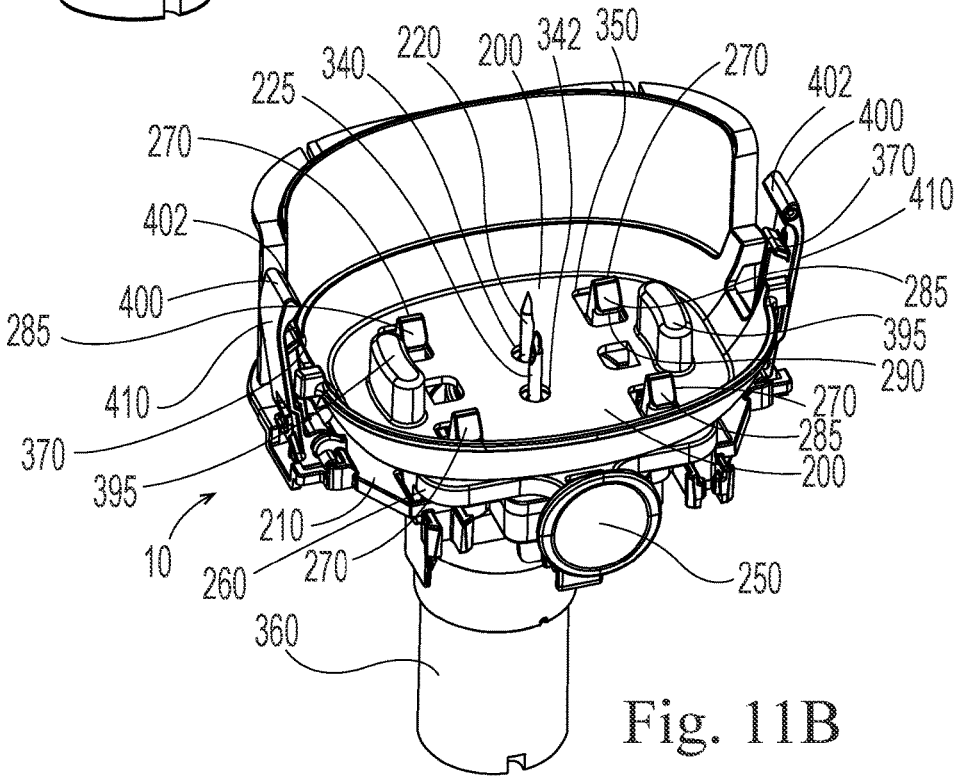
FIG. 11B is a dispensing system with the cradle in the first position.

In FIG. 11A, the cradle 200 is in the first position and the coupling shell 40 of the dispensing package 15 is not illustrated for clarity. It can be challenging for the user to unintentionally manipulate the cradle 200 into the second position without inserting the dispensing package 15 since the activation arms 400 would need to be moved outwardly to disengage the cradle supports 370 from the interior facing surface 380 of the cradle 200. As shown in FIG. 11B, when the cradle 200 is in the second position, the inlet cannulae 220 protrude up through the liquid transport apertures 340. The latches 270 also protrude up through the engagement apertures 350. The cradle supports 370 are outboard of the cradle 200 to permit movement of the cradle 200 from the first position to the second position. The activation arms 400 are also illustrated to be moved outwardly away from the z-axis as they would be when the dispensing package 15 is mounted in the cradle 200.

Figure 12:
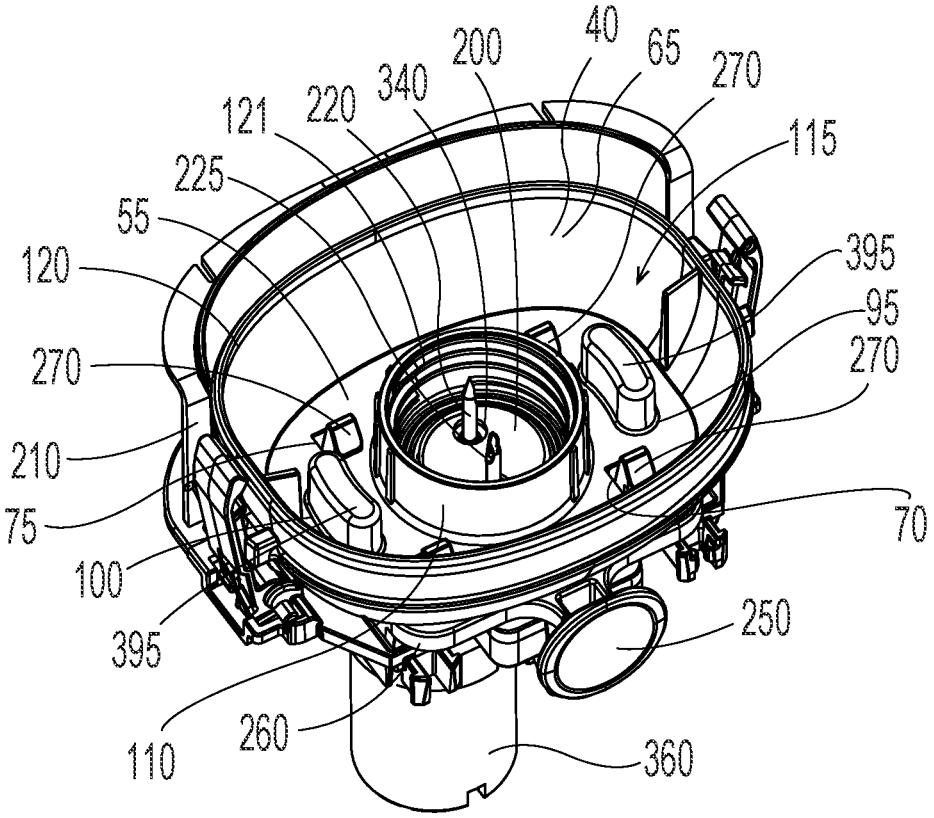
FIG. 12 is a dispensing system with the cradle in the second position and the coupling shell engaged with the latches.

As shown in FIG. 12, in which the coupling shell 40 is included in the drawing, when the cradle 200 is in the second position, the inlet cannulae 220 protrude up through the liquid transport aperture 340. The latches 270 also protrude up through the engagement apertures 350. The cradle supports 370 are outboard of the cradle 200 to permit movement of the cradle 200 from the first position to the second position. The activation arms 400 are also illustrated to be moved outwardly away from the z-axis as they would be when the dispensing package 15 is mounted in the cradle 200.

FIG. 12 illustrates the cradle 200 in the second position along with a coupling shell 40 that may form part of the dispensing package 15. As shown in FIG. 12, the latches 270 protrude up through the engagement apertures 350 of the cradle 200 and through the front apertures 70 and rear apertures 75 of the coupling shell 40. The catch sides 290 of the latches 270 are engage with the front apertures 70 and rear apertures 75 of the coupling shell 40 to secure the coupling shell 40, and the container 125 thereby, securely in the cavity 190. One or more of the engagement locations of the latches 270 with the one or more of the front apertures 70 and rear apertures 75 can provide for stability of the dispensing package 15 if the user bumps a stationary object with the mop head 20 during use.

Figure 13A:
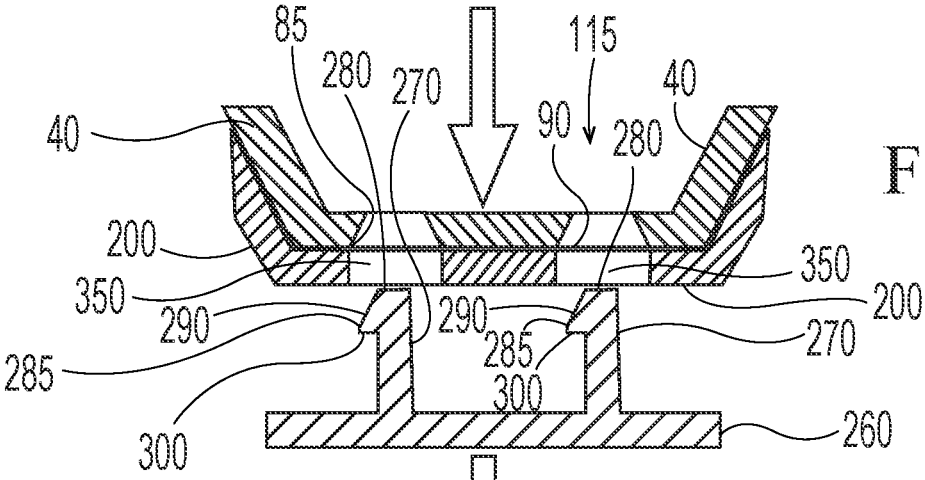
FIG. 13A illustrates the coupling shell seated in the cradle, the cradle in the first position.

FIG. 13A to 13D illustrate a manner in which the coupling shell 40 can engage with the latches 270. In FIG. 13A, the dispensing package 15 is brought by the user into proximity with the cradle 200. The frame spring 310 can be in a low or no stored energy state. The engagement apertures 350 are registered with the latches 270 so that the latches 270 can pass through the engagement apertures 350. The front apertures 70 and the rear apertures 75 are also registered with latches 270. The guides 395 are registered with the first guide aperture 95 and the second guide aperture 100.

Figure 13B:
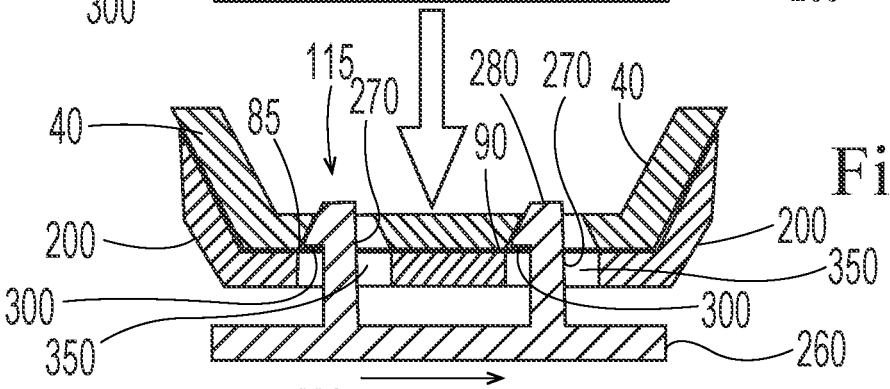
FIG. 13B illustrates the coupling shell seated in the cradle, the cradle approaching the second position and the coupling shell in contact with the latches.
Figure 13C:
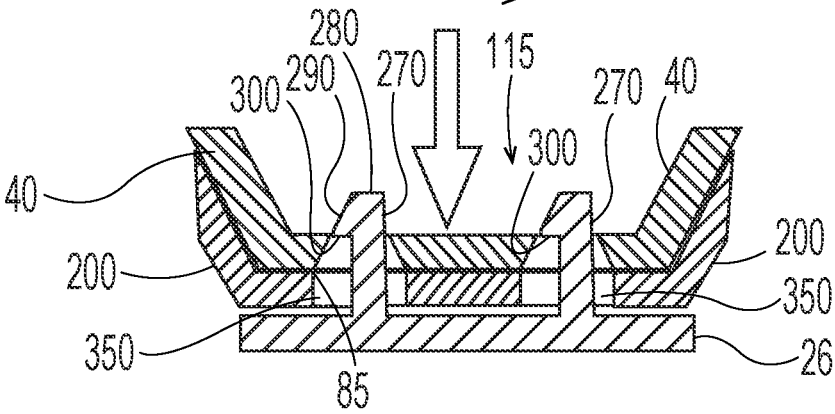
FIG. 13C illustrates the coupling shell nearly seated in the cradle, the open frame and latches displaced laterally.
Figure 13D:
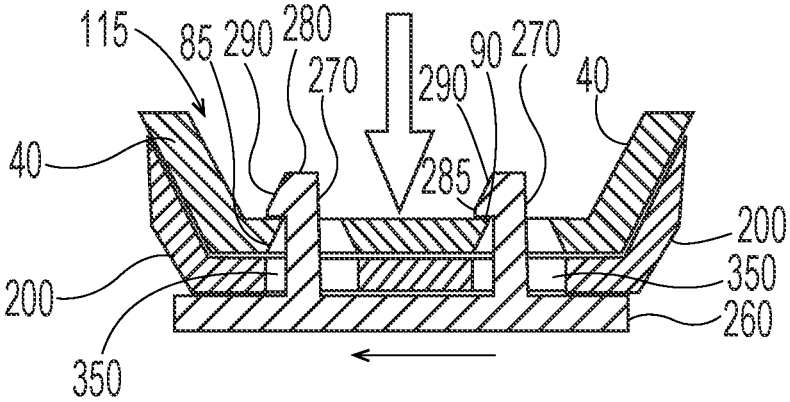
FIG. 13D illustrates the coupling shell seated in the cradle, the cradle in the second position and coupling shell the latches engaged with the latches.
Figure 14:
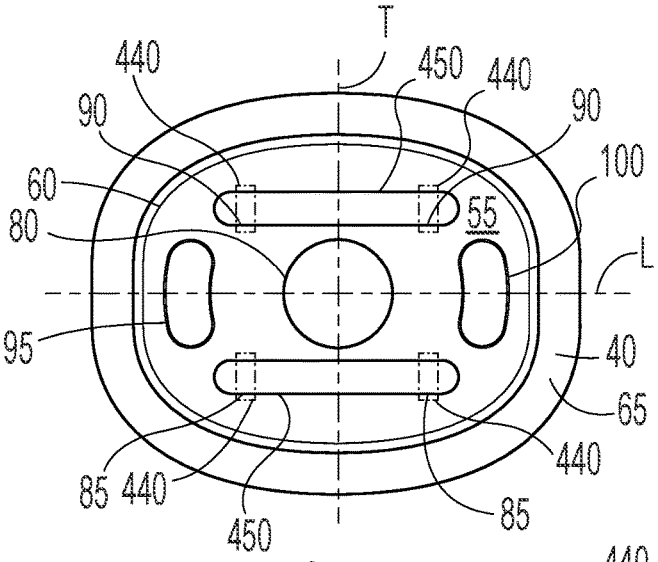
FIG. 14 is a top view of a coupling shell.
Figure 15:
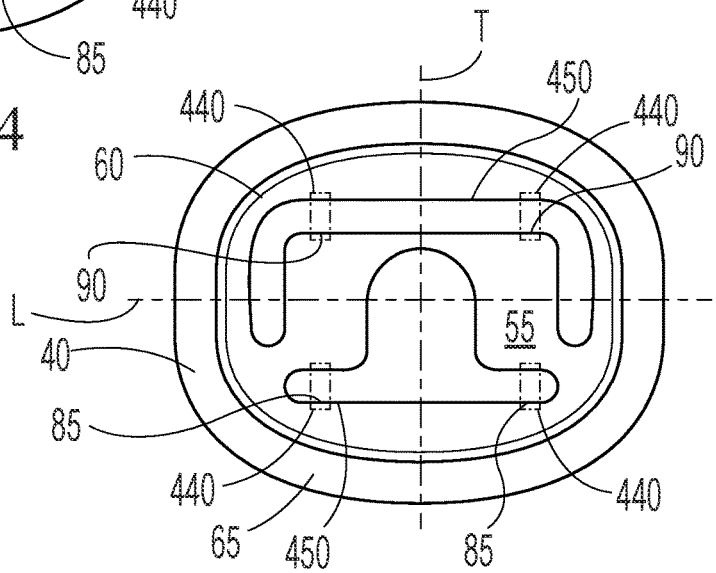
FIG. 15 is a top view of a coupling shell.
Figure 16:
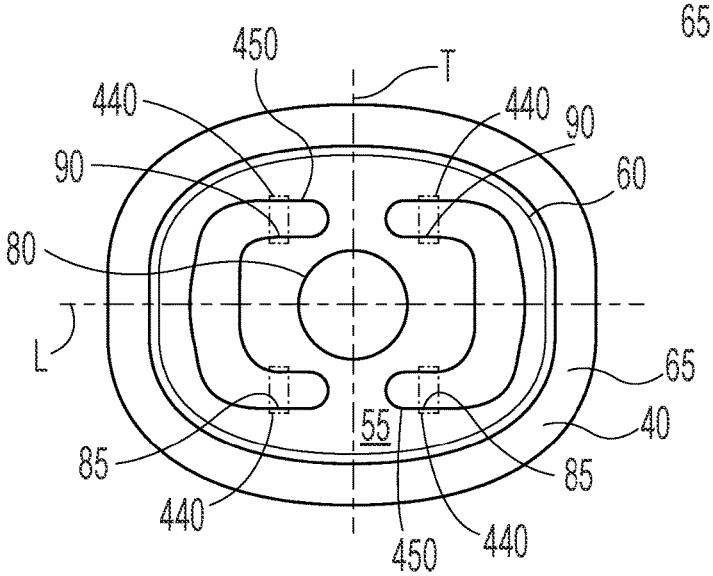
FIG. 16 is a top view of a coupling shell.
Figure 17:
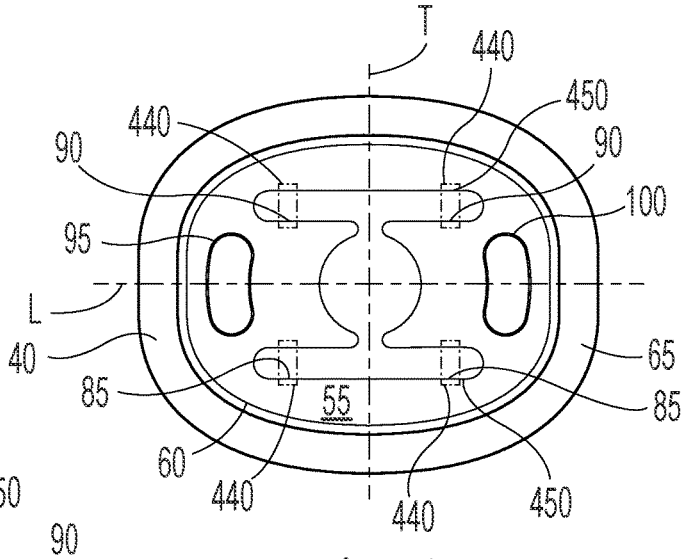
FIG. 17 is a top view of a coupling shell.
Figure 18:
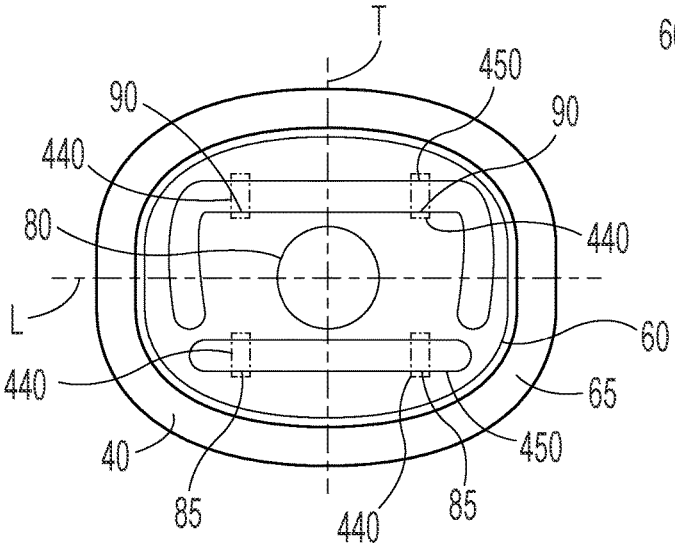
FIG. 18 is a top view of a coupling shell.
Figure 19:
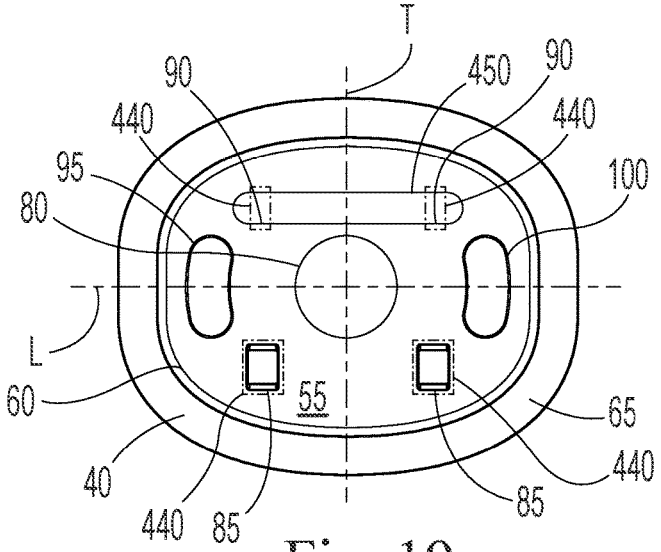
FIG. 19 is a top view of a coupling shell.
Figure 20:
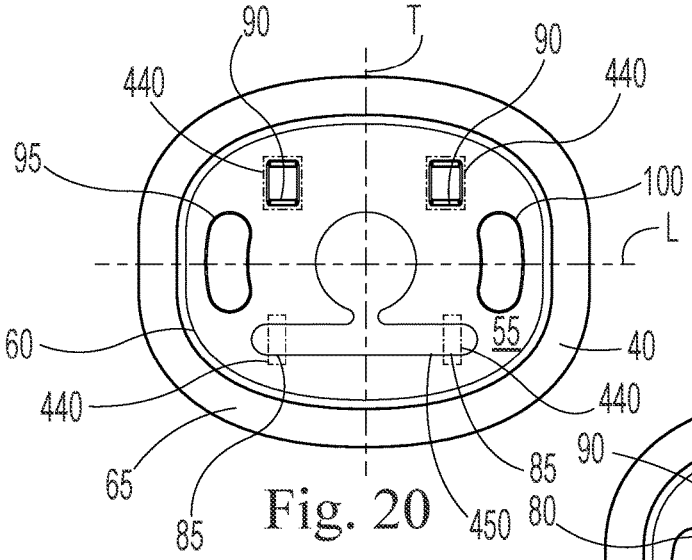
FIG. 20 is a top view of a coupling shell.
Figure 21:
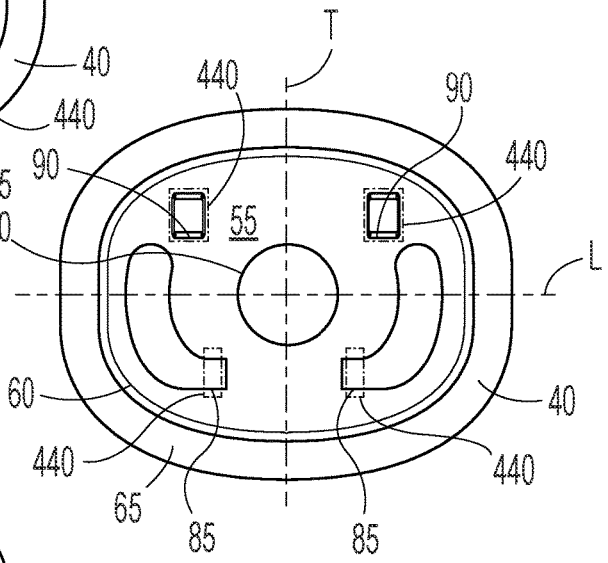
FIG. 21 is a top view of a coupling shell.
Figure 22:
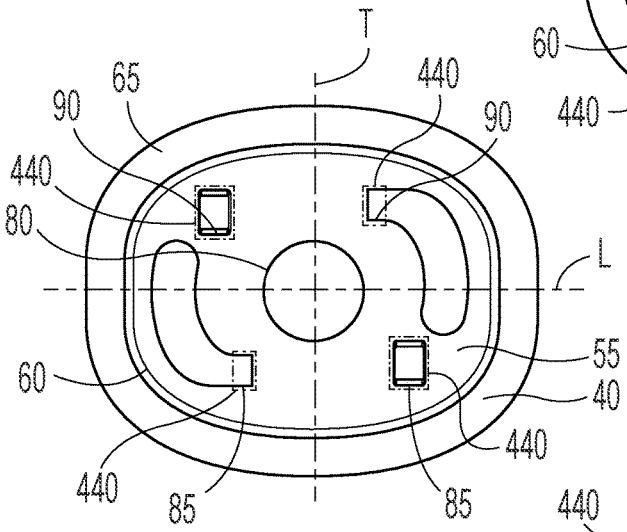
FIG. 22 is a top view of a coupling shell.

In FIG. 13B, the user pushes the dispensing package 15 downward from the first position towards the second position. The cradle spring 230 stores energy as the cradle spring 230 is loaded. The front apertures 70 and the rear apertures 75 are brought into contact with the latches 270. A beveled surface 285 of the free end 280 of the latches 270 can contact a cooperatively beveled edge of the front aperture 70 or rear aperture 75 with which the respective latch 270 registered therewith. The vertical force applied by the user to the dispensing package 15 can be transferred to the beveled surface 285 of the free end 280 of the latches 270. A component of that vertical force can provide a lateral force to move the open frame 260 laterally. When the latches 270 are pushed out of the way sufficiently (FIG. 13C), the cradle 200 can be pushed slightly further down the z-axis Z. The open frame 260 and latches 270 can move back and the catch surfaces 300 of the latches 270 can engage with coupling shell 40 (FIG. 13D).

As discussed previously, the user can disengage the dispensing package 15 by pushing on the button 250 to move the open frame 260 and disengage the latches 270 from the front apertures 70 and rear apertures 75 of the coupling shell 40. Once disengaged, the cradle spring 230 can push the cradle 200 from the second position back to the first position. In the first position, the user can disengage the dispensing package 15 from the device 1.

The dispensing package 15 can be engaged with the dispensing system 10 by the following steps. The dispensing package 15 can be manually positioned so that the coupling shell 40 is in a downward orientation. That is, the dispensing shell 40 can be oriented towards the cradle 200. The front apertures 70 are aligned with the engagement apertures 350 and the dispensing opening 80 liquid transport aperture 340. The top wall 55 is contacted to the cradle 200 manually. The container 125 is manually pushed downwardly to move the cradle 200 from the first position to the second position, whereby the inlet cannula 220 punctures the membrane seal 160. The latches 270 are engaged with the front apertures 70. The container 125 is then released leaving the dispensing package 15 engaged with the latches 270. The method can further comprise the step of contacting the dispensing package 15 to the activation arms 400 to disengage the cradle supports 370 from the interior facing surface 380. The method can further comprise the step of pushing on the button 250 to move the open frame 260 from an engaged position to a disengaged position to disengage the dispensing package 15 from the latch or latches 270.

Nonlimiting examples of coupling shells 40 that can be employed as part of the dispensing package 15 are shown in FIGS. 14-22. The coupling shell 40 can comprise at least two support zones 440. Each support zone 440 can comprise a portion of the top wall 55 and an open area 450 in the top wall 55 that is at least partially bounded by a front edge 85 that is substantially parallel or parallel to the longitudinal axis L. A front edge 85 or front edges 85 as such can provide for locations at which the dispensing package 15 securely engaged with the device 1. The open area 450 can be continuous between the support zones 440. A continuous open area 450 can help to reduce the part weight which can reduce the material and transportation costs incurred by the user and make the dispensing package 15 easier to handle.

The front edge 85 or front edges 85 can be chamfered or beveled. As described previously, chamfered or beveled front edges 85 can help guide latches 270 into the open areas 450 of the support zones 440 and potentially transfer force to the latches 270 to displace the latches 270 laterally so that the latches 270 can pass through the open areas 450 and subsequently latch onto top wall 55.

Each of the support zones 440 can be at least partially bounded by opposing front edges 85 that are substantially parallel or parallel to the longitudinal axis L. Having both opposing front edges 85 parallel or substantially parallel to the longitudinal axis L can provide for two orientations about the z-axis Z in which the dispensing package 15 can be engaged with the device 1. The opposing front edges 85 can both be chamfered or beveled so that in either orientation of the coupling shell 40 about the z-axis Z latches 270 can be conveniently fitted to the support zones 440.

Figure 23:
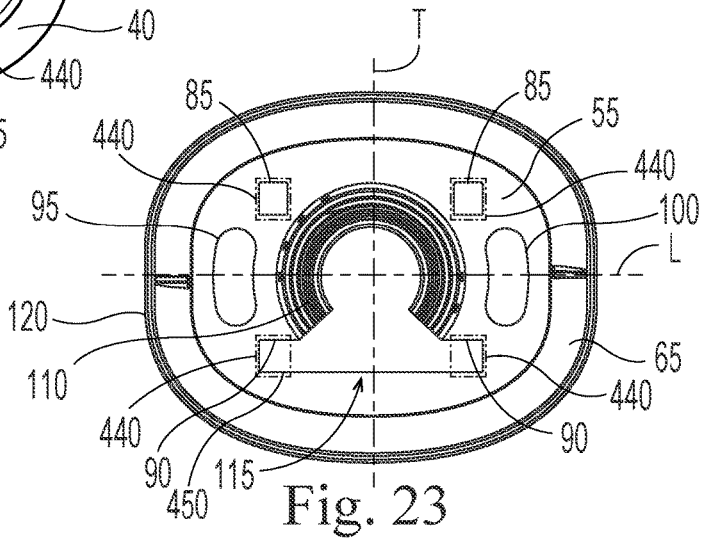
FIG. 23 is a bottom perspective view of a coupling shell.

The open area 450 can be continuous between support zones 440, for example as in FIGS. 14-20 and 23. This can reduce the weight of the coupling shell 40 and require less material to fabricate the coupling shell 40. Optionally, the open area 450 can be continuous with the neck fitment 110, which can also reduce the weight of the coupling shell 40 and reduce the amount of material used to fabricate the coupling shell 40. A nonlimiting example of such an arrangement is shown in FIG. 23, which is a bottom view of a coupling shell 40, in which the neck 110 is not continuous.

The coupling shell 40 can comprise four support zones 440. The four support zones 440 can be distributed into the four quadrants defined by the longitudinal axis L and transverse axis T. Providing four support zones 440 can provide for greater stability of engagement of the dispensing package 15 to the device 1 and provide for redundancy of the engagement. The support zones 440 can be positioned on opposite sides of the transverse axis T. Such arrangement can help stabilize the dispensing package 15 from rotational movement about the z-axis Z when the device 1 is being used. Optionally, the support zones 440 can be positioned on opposite sides of the longitudinal axis L, which can provide for stability of the dispensing package 15 for side to side movement along the longitudinal axis L of the device 1. The support zones 440 on opposite sides of the transverse axis T can be in alignment or out of alignment with one another relative to an axis parallel to the transverse axis T.

The front edges 85 can be equidistant from the longitudinal axis L. Optionally, the support zone 440 can be equidistant from the z-axis A. The support zones 440 can be equidistant from the transvers axis T. The support zones 440 can be equidistant from the longitudinal axis L. These arrangements and combinations of these arrangements can simplify mechanical design of and provide for symmetry of the mechanism for engaging the latches 270 with the dispensing package 15.

As shown in FIGS. 14-22, the open areas 450 can extend further away from the longitudinal axis L than the first guide aperture 95 and the second guide aperture 100, which may be able to increase the torque resistance of the connection between the dispensing package 15 and the device 1. Optionally, the front apertures 70 and the rear apertures 75 out of alignment with one another with respect to an axis parallel to the transvers axis T. Similarly, the support zones 440 can be out of alignment with one another with respect to an axis parallel to the transverse axis T (e.g. FIGS. 21 and 22).

A bottom view of a coupling shell 40 is shown in FIG. 23. The neck fitment 110 can partially surround the dispensing opening 80. The neck fitment 110 can surround more than about 30%, optionally more than 50%, optionally more than 80%, optionally 100%, of the dispensing opening 80. The neck fitment 110 need only have enough structure to securely engage with the neck 140 of the container 125 under the anticipated forces that the neck fitment 110 may have to withstand during manufacture, secondary packing, distribution, display on shelf, transportation to the user's home, and installation and use in the user's home.

Combinations

An example is below:

A. A dispensing package (15) for a floor treatment composition (50), said dispensing package comprising:
   - a coupling shell (40) comprising a top wall (55), wherein said top wall has a top wall periphery (60) and a shell wall (65) extending from said top wall periphery, wherein said top wall and said shell wall partially define a shell interior (115), wherein said top wall has a longitudinal axis (L), a transverse axis (T) orthogonal to said longitudinal axis and intersecting said longitudinal axis at a z-axis (Z), wherein said z-axis is orthogonal to said longitudinal axis and said transverse axis, wherein said coupling shell further comprises:
   - a front aperture (70) in said top wall;
   - a dispensing opening (80) in said top wall and aligned with said z-axis;
   - a neck fitment (110) at least partially surrounding said dispensing opening and projecting from said top wall into said shell interior and aligned with said z-axis; and
   - a container (125) comprising a base (130), and body wall (135) extending from said base towards said coupling shell and extending around said z-axis, a shoulder (137) extending from said body wall to a neck (140) that extends around said z-axis, a finish (150) that extends around said z-axis and extends from said neck to a sealing surface (155) that extends around said z-axis, and a membrane seal (160) engaged with said sealing surface, wherein said neck fitment is engaged with said neck;
   - wherein said top wall is spaced apart from said shoulder.

B. The dispensing package according to Paragraph A, wherein said dispensing package comprises a pair of said front apertures.

C. The dispensing package according to Paragraph B, wherein said pair of front apertures are on one side of said longitudinal axis.

D. The dispensing package according to Paragraph B or C, wherein said front apertures are on opposite sides of said transverse axis.

E. The dispensing package according to any of Paragraphs B to D, wherein said front apertures each have a front edge (85) oriented away from said longitudinal axis, wherein said front edges are equidistant from said longitudinal axis.

F. The dispensing package according to any of Paragraphs B to E, wherein said front apertures each have a front edge (85) oriented away from said longitudinal axis, wherein at least parts of said front edges are chamfered or beveled relative to said top wall.

G. The dispensing package according to any of Paragraphs B to F, wherein said front apertures each have a front edge (85) oriented away from said longitudinal axis, wherein said front edges are equidistant from said longitudinal axis, wherein each front edge has substantially the same shape.

H. The dispensing package according to any of Paragraphs A to G, wherein said shell wall extends in a direction along the z-axis further than said neck fitment.

I. The dispensing package according to any of Paragraphs A to H, wherein said dispensing package further comprises a first guide aperture (95) and a second guide aperture (100) in said top wall positioned along said longitudinal axis and positioned on opposite sides of said transverse axis, wherein said first guide aperture and said second guide aperture extend further away from said z-axis than said front apertures.

J. The dispensing package according to any of Paragraphs A to I, wherein said first guide aperture and said second guide aperture are each larger in area than individual front apertures.

K. The dispensing package according to any of Paragraphs A to J, wherein said dispensing opening has a smaller scalar open area than said neck fitment.

L. The dispensing package according to any of Paragraphs B to K, wherein said front apertures extend further away from said longitudinal axis than said first guide aperture and said second guide aperture.

M. The dispensing package according to any of Paragraphs A to L, wherein said shell further comprises a pair of rear apertures (75) in said top wall and positioned on opposite sides of said transverse axis, wherein said longitudinal axis is between said front apertures and said rear apertures, wherein parts of said front apertures and parts of said rear apertures are in line with one another in a direction parallel to said transverse axis.

N. The dispensing package according to Paragraph M, wherein said rear apertures each have an inward edge (90) oriented towards said longitudinal axis, wherein said inward edges are equidistant from said longitudinal axis.

O. The dispensing package according to Paragraph N, wherein at least parts of said inward edges are chamfered or beveled relative to said top wall.

P. The dispensing package according to Paragraph N or O, wherein each inward edge has substantially the same shape.

Q. The dispensing package according to any of Paragraphs M to P, wherein said rear apertures are equidistant from said longitudinal axis R. The dispensing package according to any of Paragraphs M to Q, wherein said front apertures and said rear apertures are equidistant from said longitudinal axis.

S. The dispensing package according to any of Paragraphs M to R, wherein said dispensing package further comprises a first guide aperture (95) and a second guide aperture (100) in said top wall positioned along said longitudinal axis and positioned on opposite sides of said transverse axis, wherein said first guide aperture and said second guide aperture extend further away from said z-axis than said rear apertures.

T. The dispensing package according to Paragraph S, wherein said first guide aperture and said second guide aperture are each larger in area than individual rear apertures U. The dispensing package according to Paragraph S or T, wherein said first guide aperture and said second guide aperture have a greater width measured orthogonal to said longitudinal axis than length measured along said longitudinal axis.

V. The dispensing package according to any of Paragraphs A to U, wherein said neck fitment comprises a land seal (165) engaged with said membrane seal.

W. The dispensing package according to any of Paragraphs A to V, wherein said coupling shell is more extensive along said longitudinal axis than along said transverse axis.

X. The dispensing package according to any of Paragraphs B to W, wherein said front apertures are equidistant from said z-axis.

Y. The dispensing package according to any of Paragraphs M to X, wherein said rear apertures are equidistant from said z-axis.

Z. The dispensing package according to any of Paragraphs A to Y, wherein said membrane seal is recessed relative to said top wall.

AA. The dispensing package according to any of Paragraphs A to Z, wherein said neck further comprises a thread or bead (145) projecting from said neck away from z-axis and extending around or partially around said z-axis and said neck fitment is engaged with said thread or bead.

BB. A method of engaging a dispensing package (15) according to any of Paragraphs A to AA comprising steps of:

manually positioning said coupling shell in a downward orientation;

manually aligning said z-axis of said coupling shell with a predetermined location then manually positioning said coupling shell in a disengaged position;

manually pushing downwardly on said container to move said coupling shell in a direction in alignment with said z-axis from said disengaged position into an engaged position;

releasing said dispensing package and leaving said dispensing package in said engaged position.

CC. The method according to Paragraph BB, where said method further comprises the step of piercing said membrane seal as said coupling shell is moved from said disengaged position to said engaged position.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dispensing package for a floor treatment composition, said dispensing package comprising:

a coupling comprising a top wall, wherein said top wall has a top wall periphery, wherein said top wall has a longitudinal axis, a transverse axis orthogonal to said longitudinal axis and intersecting said longitudinal axis at a z-axis, wherein said z-axis is orthogonal to said longitudinal axis and said transverse axis, wherein said coupling further comprises:

a pair of front apertures in said top wall, wherein said front apertures are on opposite sides of said transverse axis and are on one side of said longitudinal axis;

a dispensing opening in said top wall and aligned with said z-axis;

a neck fitment at least partially surrounding said dispensing opening and projecting from said top wall and aligned with said z-axis;

a first guide aperture and a second guide aperture in said top wall positioned along said longitudinal axis and positioned on opposite sides of said transverse axis, and wherein said first guide aperture and said second guide aperture extend further away from said z-axis than said front apertures; and a container comprising a base, and body wall extending from said base towards said coupling and extending around said z-axis, a shoulder extending from said body wall to a neck that extends around said z-axis, a finish that extends around said z-axis and extends from said neck to a sealing surface that extends around said z-axis, and a membrane seal engaged with said sealing surface, wherein said neck fitment is engaged with said neck;

wherein said top wall is spaced apart from said shoulder.

2. The dispensing package according to claim 1, wherein said front apertures each have a front edge oriented away from said longitudinal axis, wherein said front edges are equidistant from said longitudinal axis.

3. The dispensing package according to claim 2, wherein at least parts of said front edges are chamfered or beveled relative to said top wall.

4. The dispensing package according to claim 3, wherein each front edge has substantially the same shape.

5. The dispensing package according to claim 1, wherein said coupling extends in a direction along the z-axis further than said neck fitment.

6. The dispensing package according to claim 1, wherein said first guide aperture and said second guide aperture are each larger in area than individual front apertures.

7. The dispensing package according to claim 6, wherein said dispensing opening has a smaller scalar open area than said neck fitment.

8. The dispensing package according to claim 7, wherein said front apertures extend further away from said longitudinal axis than said first guide aperture and said second guide aperture.

9. The dispensing package according to claim 8, wherein said coupling further comprises a pair of rear apertures in said top wall and positioned on opposite sides of said transverse axis, wherein said longitudinal axis is between said front apertures and said rear apertures, wherein parts of said front apertures and parts of said rear apertures are in line with one another in a direction parallel to said transverse axis.

10. The dispensing package according to claim 9, wherein said rear apertures each have an inward edge oriented towards said longitudinal axis, wherein said inward edges are equidistant from said longitudinal axis.

11. The dispensing package according to claim 10, wherein at least parts of said inward edges are chamfered or beveled relative to said top wall.

12. The dispensing package according to claim 11, wherein said neck fitment comprises a land seal engaged with said membrane seal.

13. The dispensing package according to claim 1, wherein said coupling is more extensive along said longitudinal axis than along said transverse axis.

14. The dispensing package according to claim 1, wherein said neck further comprises a thread or bead projecting from said neck away from z-axis and extending around or partially around said z-axis and said neck fitment is engaged with said thread or bead.

15. The dispensing package according to claim 1, wherein said front apertures extend further away from said longitudinal axis than said first guide aperture and said second guide aperture.

16. The dispensing package according to claim 1, wherein said coupling further comprises a pair of rear apertures in said top wall and positioned on opposite sides of said transverse axis, wherein said longitudinal axis is between said front apertures and said rear apertures, wherein parts of said front apertures and parts of said rear apertures are in line with one another in a direction parallel to said transverse axis.

17. A dispensing package for a floor treatment composition, said dispensing package comprising:

a coupling comprising a top wall, wherein said top wall has a top wall periphery, wherein said top wall has a longitudinal axis, a transverse axis orthogonal to said longitudinal axis and intersecting said longitudinal axis at a z-axis, wherein said z-axis is orthogonal to said longitudinal axis and said transverse axis, wherein said coupling further comprises:

a front aperture in said top wall;

a dispensing opening in said top wall and aligned with said z-axis;

a neck fitment at least partially surrounding said dispensing opening and projecting from said top wall and aligned with said z-axis;

a first guide aperture and a second guide aperture in said top wall positioned along said longitudinal axis and positioned on opposite sides of said transverse axis; and a container comprising a base, and body wall extending from said base towards said coupling and extending around said z-axis, a shoulder extending from said body wall to a neck that extends around said z-axis, a finish that extends around said z-axis and extends from said neck to a sealing surface that extends around said z-axis, and a membrane seal engaged with said sealing surface, wherein said neck fitment is engaged with said neck;

wherein said top wall is spaced apart from said shoulder.

18. The dispensing package according to claim 17, wherein said coupling extends in a direction along the z-axis further than said neck fitment.

19. The dispensing package according to claim 17, wherein said front aperture extends further away from said longitudinal axis than said first guide aperture and said second guide aperture.

20. The dispensing package according to claim 17, wherein said coupling is more extensive along said longitudinal axis than along said transverse axis.

* * * * *